US006788306B2

(12) United States Patent
Yamaguchi et al.

(10) Patent No.: US 6,788,306 B2
(45) Date of Patent: Sep. 7, 2004

(54) DISPLAY APPARATUS DISPLAYING PSEUDO GRAY LEVELS AND METHOD FOR DISPLAYING THE SAME

(75) Inventors: Machihiko Yamaguchi, Tokyo (JP); Youji Hirano, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 366 days.

(21) Appl. No.: 09/987,600

(22) Filed: Nov. 15, 2001

(65) Prior Publication Data

US 2002/0105491 A1 Aug. 8, 2002

(30) Foreign Application Priority Data

Nov. 24, 2000 (JP) ..... 2000-358411

(51) Int. Cl.[7] ..... G09G 5/02

(52) U.S. Cl. ..... 345/596; 345/89; 345/690; 345/63; 348/254; 348/671; 358/455; 358/456; 358/457; 358/458; 358/459; 382/274; 382/251; 382/252

(58) Field of Search ..... 345/87, 89, 63, 345/204, 589, 596, 690; 358/534, 455, 456, 457, 458, 459; 348/254, 671; 382/274, 251, 252

(56) References Cited

U.S. PATENT DOCUMENTS 5,459,495 A * 10/1995 Scheffer et al. ..... 345/690
5,767,836 A * 6/1998 Scheffer et al. ..... 345/690
5,861,869 A * 1/1999 Scheffer et al. ..... 345/691
5,892,496 A * 4/1999 Wakeland ..... 345/694
6,043,801 A * 3/2000 Bassetti ..... 345/89
6,288,698 B1 * 9/2001 Ishii et al. ..... 345/87
6,459,817 B1 * 10/2002 Matsushiro ..... 382/251

FOREIGN PATENT DOCUMENTS

| | | |
|---|---|---|
| JP | 7-120725 | 5/1995 |
| JP | 9-90902 | 4/1997 |
| JP | 9-106267 | 4/1997 |

* cited by examiner

*Primary Examiner*—Henry N. Tran
(74) *Attorney, Agent, or Firm*—Foley and Lardner LLP

(57) ABSTRACT

A display apparatus is composed of a pseudo gray level data processor generating pseudo gray level data having m bits based on input gray level data having n bits. The pseudo gray level data processor includes a state variable generator generating a state variable data having n−m bits, based on lower n−m bits of the input gray level data, an adder calculating a sum of the lower n−m bits of the input gray level data and the state variable data to output a carry bit representative of carry-over of the sum, and a pseudo gray level data calculator generating the pseudo gray level data based on the input gray level data and the carry bit. The pseudo gray level data calculator defines the pseudo gray level data such that the pseudo gray level data equals upper m bits of the input gray level data in a first case when the carry bit is "0" and the input gray level belongs to first gray levels of the $2^n$ gray levels, and such that upper m−1 bits of the pseudo gray level data equals upper m−1 bits of the input gray level data and LSB (least significant bit) of the pseudo gray level data is selected from "0" and "1" in a second case when the carry bit is "1" and the input gray level data belongs to the first gray levels.

22 Claims, 25 Drawing Sheets

Fig. 4

ORDER OF GENERATION OF $u_r$ (i, j, k) DURING k-TH FRAME

1ST →

$u_r(1,1,k), u_r(2,1,k), \cdots, u_r(i,1,k), \cdots, u_r(p,1,k),$

2ND →

$u_r(1,2,k), u_r(2,2,k), \cdots, u_r(i,2,k), \cdots, u_r(p,2,k),$

⋮ i-TH →

$u_r(1,j,k), u_r(2,j,k), \cdots, u_r(i,j,k), \cdots, u_r(p,j,k),$

⋮ q-TH →

$u_r(1,q,k), u_r(2,q,k), \cdots, u_r(i,q,k), \cdots, u_r(p,q,k),$ r IS ANY ONE OF "RA", "GA", "BA", "RB", "GB", AND "BB"

r IS ANY ONE OF "RA", "GA", "BA", "RB", "GB" AND "BB"

Fig. 6

| | k-TH FRAME | LATERAL LINE | r | | | | | | |
|---|---|---|---|---|---|---|---|---|---|
| | | | RA | GA | BA | RB | GB | BB | |
| $41_1$ | k=8s+1 | j=4t+1 | 0 | 2 | 1 | 3 | 0 | 2 | $41_{1,1}$ |
| | | 4t+2 | 1 | 3 | 2 | 0 | 1 | 3 | $41_{1,2}$ |
| | | 4t+3 | 2 | 0 | 3 | 1 | 2 | 0 | $41_{1,3}$ |
| | | 4t+4 | 3 | 1 | 0 | 2 | 3 | 1 | $41_{1,4}$ |
| $41_2$ | k=8s+2 | 4t+1 | 2 | 0 | 3 | 1 | 2 | 0 | $41_{2,1}$ |
| | | 4t+2 | 3 | 1 | 0 | 2 | 3 | 1 | $41_{2,2}$ |
| | | 4t+3 | 0 | 2 | 1 | 3 | 0 | 2 | $41_{2,3}$ |
| | | 4t+4 | 1 | 3 | 2 | 0 | 1 | 3 | $41_{2,4}$ |
| $41_3$ | k=8s+3 | 4t+1 | 1 | 3 | 2 | 0 | 1 | 3 | $41_{3,1}$ |
| | | 4t+2 | 2 | 0 | 3 | 1 | 2 | 0 | $41_{3,2}$ |
| | | 4t+3 | 3 | 1 | 0 | 2 | 3 | 1 | $41_{3,3}$ |
| | | 4t+4 | 0 | 2 | 1 | 3 | 0 | 2 | $41_{3,4}$ |
| $41_4$ | k=8s+4 | 4t+1 | 3 | 1 | 0 | 2 | 3 | 1 | $41_{4,1}$ |
| | | 4t+2 | 0 | 2 | 1 | 3 | 0 | 2 | $41_{4,2}$ |
| | | 4t+3 | 1 | 3 | 2 | 0 | 1 | 3 | $41_{4,3}$ |
| | | 4t+4 | 2 | 0 | 3 | 1 | 2 | 0 | $41_{4,4}$ |
| $41_5$ | k=8s+5 | 4t+1 | 2 | 0 | 3 | 1 | 2 | 0 | $41_{5,1}$ |
| | | 4t+2 | 3 | 1 | 0 | 2 | 3 | 1 | $41_{5,2}$ |
| | | 4t+3 | 0 | 2 | 1 | 3 | 0 | 2 | $41_{5,3}$ |
| | | 4t+4 | 1 | 3 | 2 | 0 | 1 | 3 | $41_{5,4}$ |
| $41_6$ | k=8s+6 | 4t+1 | 0 | 2 | 1 | 3 | 0 | 2 | $41_{6,1}$ |
| | | 4t+2 | 1 | 3 | 2 | 0 | 1 | 3 | $41_{6,2}$ |
| | | 4t+3 | 2 | 0 | 3 | 1 | 2 | 0 | $41_{6,3}$ |
| | | 4t+4 | 3 | 1 | 0 | 2 | 3 | 1 | $41_{6,4}$ |
| $41_7$ | k=8s+7 | 4t+1 | 3 | 1 | 0 | 2 | 3 | 1 | $41_{7,1}$ |
| | | 4t+2 | 0 | 2 | 1 | 3 | 0 | 2 | $41_{7,2}$ |
| | | 4t+3 | 1 | 3 | 2 | 0 | 1 | 3 | $41_{7,3}$ |
| | | 4t+4 | 2 | 0 | 3 | 1 | 2 | 0 | $41_{7,4}$ |
| $41_8$ | k=8s+8 | 4t+1 | 1 | 3 | 2 | 0 | 1 | 3 | $41_{8,1}$ |
| | | 4t+2 | 2 | 0 | 3 | 1 | 2 | 0 | $41_{8,2}$ |
| | | 4t+3 | 3 | 1 | 0 | 2 | 3 | 1 | $41_{8,3}$ |
| | | 4t+4 | 0 | 2 | 1 | 3 | 0 | 2 | $41_{8,4}$ |
| | | | $40_1$ | $40_2$ | $40_3$ | $40_4$ | $40_5$ | $40_6$ | |

+1 +1 +1 +2 +3 +2 +3 +2 +3 +2 +3 s AND t ARE INTEGERS EQUAL TO OR MORE THAN 0

Fig. 8

| INPUT GRAY LEVEL DATA $u_r$ | | PSEUDO GRAY LEVEL DATA $y_r$ | | |
|---|---|---|---|---|
| DECIMAL NOTATION | BINARY NOTATION | $CRY_r$ = "0" | $CRY_r$ = "1" | |
| 255 | 11111111 | 111111 | 111111 | CASE 4 |
| 254 | 11111110 | $y_rH$="11111" $y_rLSB=w_r$ (CASE 3-1) | $y_r$="111111" (CASE 3-2) | CASE 3 |
| 253 | 11111101 | | | |
| 252 | 11111100 | | - | |
| 251 | 11111011 | $y_r$="111110" (CASE 2-1) | $y_rH$="11111" $y_rLSB=w_r$ (CASE 2-2) | CASE 2 |
| 250 | 11111010 | | | |
| 249 | 11111001 | | | |
| 248 | 11111000 | | - | |
| ⋮ | ⋮ | ⋮ | ⋮ | CASE 1 |
| 7 | 00000111 | 000001 | 000010 | |
| 6 | 00000110 | 000001 | 000010 | |
| 5 | 00000101 | 000001 | 000010 | |
| 4 | 00000100 | 000001 | - | |
| 3 | 00000011 | 000000 | 000001 | |
| 2 | 00000010 | 000000 | 000001 | |
| 1 | 00000001 | 000000 | 000001 | |
| 0 | 00000000 | - | 000000 | |

Fig. 9

| i, j, k | ACTIVATED PIXEL | $u_{RA}$ | $u_{RA}{}^{L}$ | $x_{RA}$ | $v_{RA}$ | $CRY_{RA}$ | $w_{RA}$ | $y_{RL}{}^{LSB}$ | $y_{RA}$ | CORRESPONDING CASE |
|---|---|---|---|---|---|---|---|---|---|---|
| 1, 1, 1 | $PIXEL8_{1,1}$ | 11111001 | 01 | 00 | 01 | 0 | 0 | 0 | 111110 | CASE2-1 |
| 2, 1, 1 | $PIXEL8_{3,1}$ | 11111001 | 01 | 01 | 10 | 0 | 0 | 0 | 111110 | CASE2-1 |
| 3, 1, 1 | $PIXEL8_{5,1}$ | 11111001 | 01 | 10 | 11 | 0 | 0 | 0 | 111110 | CASE2-1 |
| 4, 1, 1 | $PIXEL8_{7,1}$ | 11111001 | 01 | 11 | 00 | 1 | 0 | 0 | 111110 | CASE2-2 |
| 5, 1, 1 | $PIXEL8_{9,1}$ | 11111001 | 01 | 00 | 01 | 0 | 1 | 0 | 111110 | CASE2-1 |
| 6, 1, 1 | $PIXEL8_{11,1}$ | 11111001 | 01 | 01 | 10 | 0 | 1 | 0 | 111110 | CASE2-1 |
| 7, 1, 1 | $PIXEL8_{13,1}$ | 11111001 | 01 | 10 | 11 | 0 | 1 | 0 | 111110 | CASE2-1 |
| 8, 1, 1 | $PIXEL8_{15,1}$ | 11111001 | 01 | 11 | 00 | 1 | 1 | 1 | 111111 | CASE2-2 |

TOGGLE

Fig. 10

| j \ i | | 1 | | | | | | 2 | | | | | | 3 | | | | | | 4 | | | | | | 5 | | | | | | 6 | | | | | | 7 | | | | | | 8 | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | | LINE $6_1$ | | | $6_2$ | | | $6_3$ | | | $6_4$ | | | $6_5$ | | | $6_6$ | | | $6_7$ | | | $6_8$ | | | $6_9$ | | | $6_{10}$ | | | $6_{11}$ | | | $6_{12}$ | | | $6_{13}$ | | | $6_{14}$ | | | $6_{15}$ | | | $6_{16}$ | | |
| | | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB |
| 1 | LINE $7_1$ | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 |
| 2 | $7_2$ | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 |
| 3 | $7_3$ | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 |
| 4 | $7_4$ | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 |
| 5 | $7_5$ | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 |
| 6 | $7_6$ | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 |
| 7 | $7_7$ | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 |
| 8 | $7_8$ | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 |
| 9 | $7_9$ | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 |
| 10 | $7_{10}$ | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 |

Fig. 11

| i, j, k | ACTIVATED PIXEL | $u_{RA}$ | $u_{RA}^{L}$ | $x_{RA}$ | $v_{RA}$ | $CRY_{RA}$ | $w_{RA}$ | $y_{RL}^{LSB}$ | $y_{RA}$ | CORRESPONDING CASE |
|---|---|---|---|---|---|---|---|---|---|---|
| 1, 1, 1 | $PIXEL8_{1,1}$ | 11111110 | 10 | 00 | 10 | 0 | 0 | 0 | 111110 | CASE3-1 |
| | | | | | | TOGGLE | | | | |
| 2, 1, 1 | $PIXEL8_{3,1}$ | 11111110 | 10 | 10 | 00 | 1 | 1 | 1 | 111111 | CASE3-2 |
| 3, 1, 1 | $PIXEL8_{5,1}$ | 11111110 | 10 | 00 | 10 | 0 | 1 | 1 | 111111 | CASE3-1 |
| | | | | | | TOGGLE | | | | |
| 4, 1, 1 | $PIXEL8_{7,1}$ | 11111110 | 10 | 10 | 00 | 1 | 0 | 1 | 111111 | CASE3-2 |
| 5, 1, 1 | $PIXEL8_{9,1}$ | 11111110 | 10 | 00 | 10 | 0 | 0 | 0 | 111110 | CASE3-1 |
| | | | | | | TOGGLE | | | | |
| 6, 1, 1 | $PIXEL8_{11,1}$ | 11111110 | 10 | 10 | 00 | 1 | 1 | 1 | 111111 | CASE3-2 |
| 7, 1, 1 | $PIXEL8_{13,1}$ | 11111110 | 10 | 00 | 10 | 0 | 1 | 1 | 111111 | CASE3-1 |
| | | | | | | TOGGLE | | | | |
| 8, 1, 1 | $PIXEL8_{15,1}$ | 11111110 | 10 | 10 | 00 | 1 | 0 | 1 | 111111 | CASE3-2 |

Fig. 12

| j \ i | | 1 | | | | | | 2 | | | | | | 3 | | | | | | 4 | | | | | | 5 | | | | | | 6 | | | | | | 7 | | | | | | 8 | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | | LINE $6_1$ | | | $6_2$ | | | $6_3$ | | | $6_4$ | | | $6_5$ | | | $6_6$ | | | $6_7$ | | | $6_8$ | | | $6_9$ | | | $6_{10}$ | | | $6_{11}$ | | | $6_{12}$ | | | $6_{13}$ | | | $6_{14}$ | | | $6_{15}$ | | | $6_{16}$ | | |
| | | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB | RA | rGA | BA | RB | rGB | BB |
| 1 | LINE $7_1$ | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 |
| 2 | $7_2$ | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 |
| 3 | $7_3$ | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 |
| 4 | $7_4$ | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 |
| 5 | $7_5$ | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 |
| 6 | $7_6$ | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 |
| 7 | $7_7$ | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 |
| 8 | $7_8$ | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 |
| 9 | $7_9$ | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 |
| 10 | $7_{10}$ | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 |

Fig. 14

| LINE | LINE COMBINATION PATTERN | | | | | |
|---|---|---|---|---|---|---|
| | 1 | 2 | 3 | 4 | 5 | 6 |
| 1 | +1 | +1 | +2 | +2 | +3 | +3 |
| 2 | +1 | +2 | +1 | +3 | +2 | +3 |
| 3 | +1 | +3 | +2 | +2 | +1 | +3 |
| 4 | | | | | | |

Fig. 17

| INPUT GRAY LEVEL DATA $u_r$ | | PSEUDO GRAY LEVEL DATA $y_r$ | | |
|---|---|---|---|---|
| DECIMAL NOTATION | BINARY NOTATION | $CRY_r$ = "0" | $CRY_r$ = "1" | |
| 0 | 00000000 | 000000 | 000000 | CASE 4 |
| 1 | 00000001 | $y_rH$="00000" $y_rLSB=w_r$ (CASE 3-1) | $y_r$="000000" (CASE 3-2) | CASE 3 |
| 2 | 00000010 | | | |
| 3 | 00000011 | | – | |
| 4 | 00000100 | $y_r$="000001" (CASE 2-1) | $y_rH$="00000" $y_rLSB=w_r$ (CASE 2-2) | CASE 2 |
| 5 | 00000101 | | | |
| 6 | 00000110 | | | |
| 7 | 00000111 | | – | |
| ⋮ | ⋮ | ⋮ | ⋮ | CASE 1 |
| 248 | 11111000 | 111110 | 111101 | |
| 249 | 11111001 | 111110 | 111101 | |
| 250 | 11111010 | 111110 | 111101 | |
| 251 | 11111011 | 111110 | – | |
| 252 | 11111100 | 111111 | 111110 | |
| 253 | 11111101 | 111111 | 111110 | |
| 254 | 11111110 | 111111 | 111110 | |
| 255 | 11111111 | – | 111111 | |

Fig. 20

| INPUT GRAY LEVEL DATA $u_r$ | | PSEUDO GRAY LEVEL DATA $y_r$ | | |
|---|---|---|---|---|
| DECIMAL NOTATION | BINARY NOTATION | $CRY_r$ = "0" | $CRY_r$ = "1" | |
| 255 | 11111111 | 111111 | 111111 | CASE4 |
| 254 | 11111110 | $y_rH$="11111" $y_rLSB=z_r$ (CASE3-1) | $y_r$="111111" (CASE3-2) | CASE3 |
| 253 | 11111101 | | | |
| 252 | 11111100 | | - | |
| 251 | 11111011 | $y_r$="111110" (CASE2-1) | $y_rH$="11111" $y_rLSB=z_r$ (CASE2-2) | CASE2 |
| 250 | 11111010 | | | |
| 249 | 11111001 | | | |
| 248 | 11111000 | | - | |
| ⋮ | ⋮ | ⋮ | ⋮ | CASE1 |
| 7 | 00000111 | 000001 | 000010 | |
| 6 | 00000110 | 000001 | 000010 | |
| 5 | 00000101 | 000001 | 000010 | |
| 4 | 00000100 | 000001 | - | |
| 3 | 00000011 | 000000 | 000001 | |
| 2 | 00000010 | 000000 | 000001 | |
| 1 | 00000001 | 000000 | 000001 | |
| 0 | 00000000 | - | 000000 | |

Fig. 21A $z_r(j, k)$ WHEN K=8s+1, 8s+2, 8s+3, 8s+4
[(8s+1)-TH, (8s+2)-TH, (8s+3)-TH , (8s+4)-TH FRAME]

| | | LONGITUDINAL LINE $6_{2t-1}$ | | | LONGITUDINAL LINE $6_{2i}$ | | |
|---|---|---|---|---|---|---|---|
| | | r | | | r | | |
| | | RA | GA | BA | RB | GB | BB |
| LATERAL LINE $7_j$ | j=8t+1 | 0 | 0 | 0 | 1 | 1 | 1 |
| | 8t+2 | 0 | 0 | 0 | 1 | 1 | 1 |
| | 8t+3 | 0 | 0 | 0 | 1 | 1 | 1 |
| | 8t+4 | 0 | 0 | 0 | 1 | 1 | 1 |
| | 8t+5 | 1 | 1 | 1 | 0 | 0 | 0 |
| | 8t+6 | 1 | 1 | 1 | 0 | 0 | 0 |
| | 8t+7 | 1 | 1 | 1 | 0 | 0 | 0 |
| | 8t+8 | 1 | 1 | 1 | 0 | 0 | 0 |

EQUAL TO s AND t ARE INTEGERS 0 OR MORE

Fig. 21B $z_r(j, k)$ WHEN K=8s+5, 8s+6, 8s+7, 8s+8
[(8s+5)-TH, (8s+6)-TH, (8s+7)-TH , (8s+8)-TH FRAME]

| | | LONGITUDINAL LINE $6_{2t-1}$ | | | LONGITUDINAL LINE $6_{2i}$ | | |
|---|---|---|---|---|---|---|---|
| | | r | | | r | | |
| | | RA | GA | BA | RB | GB | BB |
| LATERAL LINE $7_j$ | j=8t+1 | 1 | 1 | 1 | 0 | 0 | 0 |
| | 8t+2 | 1 | 1 | 1 | 0 | 0 | 0 |
| | 8t+3 | 1 | 1 | 1 | 0 | 0 | 0 |
| | 8t+4 | 1 | 1 | 1 | 0 | 0 | 0 |
| | 8t+5 | 0 | 0 | 0 | 1 | 1 | 1 |
| | 8t+6 | 0 | 0 | 0 | 1 | 1 | 1 |
| | 8t+7 | 0 | 0 | 0 | 1 | 1 | 1 |
| | 8t+8 | 0 | 0 | 0 | 1 | 1 | 1 |

EQUAL TO s AND t ARE INTEGERS 0 OR MORE

Fig. 22

| j \ i | LINE $7_1$ | 1 | | | | | | 2 | | | | | | 3 | | | | | | 4 | | | | | | 5 | | | | | | 6 | | | | | | 7 | | | | | | 8 | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | | LINE $6_1$ | | | $6_2$ | | | $6_3$ | | | $6_4$ | | | $6_5$ | | | $6_6$ | | | $6_7$ | | | $6_8$ | | | $6_9$ | | | $6_{10}$ | | | $6_{11}$ | | | $6_{12}$ | | | $6_{13}$ | | | $6_{14}$ | | | $6_{15}$ | | | $6_{16}$ | | |
| | | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB |
| 1 | LINE $7_1$ | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 |
| 2 | LINE $7_2$ | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 |
| 3 | LINE $7_3$ | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 |
| 4 | LINE $7_4$ | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 |
| 5 | LINE $7_5$ | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 |
| 6 | LINE $7_6$ | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 |
| 7 | LINE $7_7$ | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 |
| 8 | LINE $7_8$ | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 |
| 9 | LINE $7_9$ | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 |
| 10 | LINE $7_{10}$ | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 | 0 | 1 | 0 | 0 | 0 | 1 | 0 | 0 | 1 | 0 | 0 | 0 | 1 | 0 | 0 | 0 | 1 | 0 | 0 | 0 | 0 | 1 | 0 | 0 |

Fig. 23

| j \ i | | 1 | | | | | | 2 | | | | | | 3 | | | | | | 4 | | | | | | 5 | | | | | | 6 | | | | | | 7 | | | | | | 8 | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | | LINE $6_1$ | | | $6_2$ | | | $6_3$ | | | $6_4$ | | | $6_5$ | | | $6_6$ | | | $6_7$ | | | $6_8$ | | | $6_9$ | | | $6_{10}$ | | | $6_{11}$ | | | $6_{12}$ | | | $6_{13}$ | | | $6_{14}$ | | | $6_{15}$ | | | $6_{16}$ | | |
| | | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB | RA | GA | BA | RB | GB | BB |
| 1 | LINE $7_1$ | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 |
| 2 | $7_2$ | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 |
| 3 | $7_3$ | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 |
| 4 | $7_4$ | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 |
| 5 | $7_5$ | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 |
| 6 | $7_6$ | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 |
| 7 | $7_7$ | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 |
| 8 | $7_8$ | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 |
| 9 | $7_9$ | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 | 0 | 1 | 0 | 1 | 0 | 1 | 1 | 0 | 1 | 0 | 1 | 0 |
| 10 | $7_{10}$ | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 |

Fig. 25

| INPUT GRAY LEVEL DATA $u_r$ | | PSEUDO GRAY LEVEL DATA $y_r$ | | |
|---|---|---|---|---|
| DECIMAL NOTATION | BINARY NOTATION | $CRY_r$ = "0" | $CRY_r$ = "1" | |
| 0 | 00000000 | 000000 | 000000 | CASE4 |
| 1 | 00000001 | $y_rH$="00000" $y_rLSB=z_r$ (CASE3-1) | $y_r$="000000" (CASE3-2) | CASE3 |
| 2 | 00000010 | | | |
| 3 | 00000011 | | - | |
| 4 | 00000100 | $y_r$="000001" (CASE2-1) | $y_rH$="00000" $y_rLSB=z_r$ (CASE2-2) | CASE2 |
| 5 | 00000101 | | | |
| 6 | 00000110 | | | |
| 7 | 00000111 | | - | |
| ⋮ | ⋮ | ⋮ | ⋮ | CASE1 |
| 248 | 11111000 | 111110 | 111101 | |
| 249 | 11111001 | 111110 | 111101 | |
| 250 | 11111010 | 111110 | 111101 | |
| 251 | 11111011 | 111110 | - | |
| 252 | 11111100 | 111111 | 111110 | |
| 253 | 11111101 | 111111 | 111110 | |
| 254 | 11111110 | 111111 | 111110 | |
| 255 | 11111111 | - | 111111 | |

DISPLAY APPARATUS DISPLAYING PSEUDO GRAY LEVELS AND METHOD FOR DISPLAYING THE SAME

BACKGROUND OF THE INVENTION

1. Field of the Invention

The present invention is related to a display apparatus. More particularly, the present invention is related to a display apparatus displaying pseudo gray levels or shades and method for displaying the same.

2. Description of the Related Art

A large number of gray levels are requested for improving the quality of pictures displayed by display devices, such as an LCD (Liquid Crystal Display) and a PDP (Plasma Display Panel). However, the limited number of gray levels are available in such display devices.

A pseudo gray level method is often used for increasing the number of displayable gray levels. The pseudo gray level method generates an m-bit gray level signal from an original n-bit gray level signal (n being larger than m) to enable the display which can physically display $2^m$ gray levels to display $2^n$ gray levels in appearance.

A pseudo gray level processor for implementing the pseudo gray level method is disclosed by Matsunaga et al. in Japanese Laid Open Patent Application (JP-A-Heisei 9-90902). The conventional pseudo gray level processor implements the error diffusion method for displaying pseudo gray levels. The conventional pseudo gray level processor is provided with a one-dot delay circuit 151, a first adder 152, an error diffusion calculating circuit 156 and a an initial value setting circuit 170, as shown in FIG. 1. The error diffusion calculating circuit 156 is composed of a second adder 158, a one-dot delay circuit 160, a switching circuit 162, a calculation control circuit 164 and a threshold setting circuit 168. The initial value setting circuit 170 is composed of an initial value setting ROM 172, a line counter 174 and a frame counter 176.

The error diffusion calculating circuit 156 carries out an error diffusion calculation on the basis of a lower bit data A which is lower (n−m) bits of an n-bit (for example, 8-bit) input picture data. The calculation control circuit 164 calculates a value δ by $$\delta = D - S,$$

where D is a value sent from the one-dot delay circuit 160, and S is a threshold sent from the threshold setting circuit 168. Then the calculation control circuit 164 sends "1" as a carry value E to the first adder 152 when the value δ is 0 or more.

The first adder 152 adds the carry value E and data B that is upper m bits (for example, 5 bits) of the picture signal to generate a pseudo gray level data F. The first adder 152 outputs the pseudo gray level data F to a display panel.

The initial value setting circuit 170 sends an initial value of the error diffusion calculating circuit 156. The initial value is different for each line of the display panel to erase the directivity of a diffusion pattern. Moreover, the pseudo gray level processor does not require a line memory for each line of the display panel.

However, the number of gray levels that can be represented by the pseudo gray level data F is smaller than the number of gray levels that can be represented by an input picture data A. The reason is as follows. If all the upper m bits of the input picture data A are "1", all the bits of the pseudo gray level data F are "1" for any values of the lower bits (n−m) of the input picture data A. The number of gray level in which the upper m bits are all "1" is 2(n−m). When the input picture data representative of any of the 2(n−m) gray levels is inputted, the pseudo gray level data F have the value in which all the bits are "1". Therefore, the pseudo gray level data F can represent only $2^n - 2^{(n-m)} + 1$ gray levels. The pseudo gray level processor desirably allows the pseudo gray level data of m bits to represent all the $2^n$ gray levels for n larger than m.

Frame rate control is another typical technique for increasing displayable gray levels. A frame rate control method is disclosed by Miyatake in Japanese Laid Open Patent Application (Jp-A-Heisei 7-120725). Miyatake describes a method for driving a LCD in which a gray level signal applied to an LCD pixel is switched every frame and has different signs and effective voltages for former n frames and latter n frames of successive 2n frames.

Still another technique which may be related to the present invention is disclosed by Furuhashi et al. in Japanese Laid Open Patent Application (Jp-A-Heisei 9-106267). Furuhashi et al. disclose an LCD for increasing contrast. One electrode of each LCD pixel is a drive electrode driven by a LCD driver, and another is a common plate electrode. The LCD includes a plate electrode driver for driving the plate electrode. The plate electrode driver latches the upper bits of the gray level data, and outputs one of predetermined voltages in response to the upper bits. The plate electrode driver allows the LCD pixels to be applied with a voltage larger than a dynamic range of the LCD driver, and increase the contrast of the LCD. However, Furuhashi et al. does not describe the pseudo gray levels.

SUMMARY OF THE INVENTION

Therefore, the object of the present invention is to provide an improved method for displaying pseudo gray levels.

More particularly, the object of the present invention is to provide a pseudo gray level processor which allows the pseudo gray level data of m bits to represent all the $2^n$ gray levels for n larger than m.

Another object of the present invention is to provide a pseudo gray level processor for generating an m-bit pseudo gray level signal from an n-bit input gray level signal (n being larger than m) such that a fixed pattern is hard to be induced in a picture displayed by a display apparatus.

In order to achieve an aspect of the present invention, a display apparatus is composed of a pseudo gray level data processor. The pseudo gray level data processor generates pseudo gray level data having m bits based on input gray level data having n bits representative of an input gray level of $2^n$ gray levels, where n is a natural number equal to or more than 2, and m is a natural number less than n. The pseudo gray level data processor includes a state variable generator, an adder and a pseudo gray level data generator. The state variable generator generates a state variable data having n−m bit(s) on the basis of lower n−m bit(s) of the input gray level data. The adder calculates a sum of the lower n−m bit(s) of the input gray level data and the state variable data, and outputs a carry bit representative of carry-over of the sum. The pseudo gray level data generator generates the pseudo gray level data based on the input gray level data and the carry bit. In a first case when the carry bit is "0" and the input gray level belongs to first gray levels of the $2^n$ gray levels, the pseudo gray level data generator defines the pseudo gray level data such that the pseudo gray level data equals upper m bits of the input gray level data in a first case. In a second case when the carry bit is "1" and the input gray level data belongs to the first gray levels, the pseudo gray level data generator defines the pseudo gray level data such that upper m−1 bit(s) of the pseudo gray level data equals upper m−1 bit(s) of the input gray level data and the LSB (least significant bit) of the pseudo gray level data is selected from "0" and "1".

It is desirable that upper m−1 bit(s) of the input gray level data are "1" and the m-th significant bit of the input gray level data is "0" when the input gray level data represents any one of the first gray levels.

In addition, a first probability of the LSB of the pseudo gray level data being "0" in the second case substantially equals a second probability of the LSB of the pseudo gray level data being "1" in the second case.

When the display apparatus further includes a pixel matrix unit including pixels displaying a displaying gray level indicated by the pseudo gray level data, the pseudo gray level data generator preferably determines the LSB of the pseudo gray level data in response to a position of the pixels in the pixel matrix unit.

When the pixels includes first and second pixels, the first pixels displaying a first displaying gray level indicated by the pseudo gray level data having the LSB of "1" in the second case, the second pixels displaying a second displaying gray level indicated by the pseudo gray level data having the LSB of "0" in the second case, and the pixel matrix unit includes a first area in which the first pixels are located and a second area in which the second pixels are located, it is desirable that the first and second area are alternately located in the pixel matrix unit.

It is also desirable that the pseudo gray level data generator defines the gray level data such that the pseudo gray level data equals upper m bits of the input gray level data in a third case when the carry bit is "1" and the input gray level belongs to second gray levels of the $2^n$ gray levels other than the first gray levels, and such that upper m−1 bits of the pseudo gray level data equals upper m−1 bits of the input gray level data and the LSB of the pseudo gray level data is selected from "0" and "1" in a fourth case when the carry bit is "0" and the input gray level data belongs to the second gray levels.

In this case, it is desirable that upper m bits of the input gray level data are "1" and at least one of lower n−m bits of the input gray level data is "0" when the input gray level data represents any one of the second gray levels.

Furthermore, a third probability of the LSB of the pseudo gray level data being "0" in the fourth case is preferably substantially equal to a fourth probability of the LSB of the pseudo gray level data being "1" in the fourth case.

The pseudo gray level data generator preferably defines the pseudo gray level data such that the pseudo gray level data equals a sum of the carry bit and upper m bits of the input gray level data in a fifth case when the input gray level does not belong to any of the first and second gray levels.

The state variant data are preferably defined by $$x(1)=x_{INI}, \text{ and}$$

$$x(i)=u_L(i-1)+x(i-1)(i\geqq 2),$$

where i is a natural number, u(i) is one of the input gray level data which is i-th inputted to the pseudo gray level data processor, $u_L(i)$ are lower n-m bits of u(i), x(i) is one of the state variant data which is produced in response to u(i), and $x_{INI}$ is a predetermined value.

In order to achieve another aspect of the present invention, a display apparatus is composed of a pseudo gray level data processor generating pseudo gray level data having m bits based on input gray level data having n bits representative of an input gray level of $2^n$ gray levels, n being a natural number equal to or more than 2, and m being a natural number less than n. The pseudo gray level data processor includes a state variable generator, an adder, and a pseudo gray level generator. The state variable generator generates a state variable data having n−m bits, based on lower n−m bits of the input gray level data. The adder calculates a sum of the lower n−m bits of the input gray level data and the state variable data to output a carry bit representative of carry-over of the sum. The pseudo gray level data generator generates the pseudo gray level data based on the input gray level data and the carry bit. In a third case when the carry bit is "1" and the input gray level belongs to second gray levels of the $2^n$ gray levels, the pseudo gray level data generator defines the pseudo gray level data such that the pseudo gray level data equals upper m bits of the input gray level data. In a fourth case when the carry bit is "0" and the input gray level data belongs to the second gray levels, the pseudo gray level data generator defines the pseudo gray level data such that upper m−1 bits of the pseudo gray level data equals upper m−1 bits of the input gray level data and the LSB (least significant bit) of the pseudo gray level data is selected from "0" and "1".

In order to achieve still another aspect of the present invention, a display apparatus is composed of a pseudo gray level data processor generating pseudo gray level data having m bits based on input gray level data having n bits representative of an input gray level of $2^n$ gray levels, n being a natural number equal to or more than 2, and m being a natural number less than n. The pseudo gray level data processor includes a state variable generator, a subtracter, and a pseudo gray level data generator. The state variable generator generates a state variable data having n−m bits, based on lower n−m bits of the input gray level data. The subtracter calculates the difference the lower n−m bits of the input gray level data minus and the state variable data to output a carry bit representative of carry-over of the difference. The pseudo gray level data generator generates the pseudo gray level data based on the input gray level data and the carry bit. In a first case when the carry bit is "0" and the input gray level belongs to first gray levels of the $2^n$ gray levels, the pseudo gray level data generator defines the pseudo gray level data such that the pseudo gray level data equals upper m bits of the input gray level data. In a second case when the carry bit is "1" and the input gray level data belongs to the first gray levels, the pseudo gray level data generator defines the pseudo gray level data such that upper m−1 bits of the pseudo gray level data equals upper m−1 bits of the input gray level data and LSB (least significant bit) of the pseudo gray level data is selected from "0" and "1".

It is desirable that the pseudo gray level data generator defines the gray level data such that the pseudo gray level data equals upper m bits of the input gray level data in a third case when the carry bit is "1" and the input gray level belongs to second gray levels of the $2^n$ gray levels other than the first gray levels, and such that upper m−1 bits of the pseudo gray level data equals upper m−1 bits of the input gray level data and the LSB of the pseudo gray level data is selected from "0" and "1" in a fourth case when the carry bit is "0" and the input gray level data belongs to the second gray levels.

The pseudo gray level data generator preferably defines the pseudo gray level data such that the pseudo gray level data equals a difference upper m bits of the input gray level data minus the carry bit in a fifth case when the input gray level does not belong to any of the first and second gray levels.

The state variable data are preferably defined by $$x(1)=x_{INI}, \text{ and}$$

$$x(i)=u_L(i-1)+x(i-1)(i\geqq 2),$$

where i is a natural number, u(i) is one of the input gray level data which is i-th inputted to the pseudo gray level data processor, $u_L(i)$ are lower n-m bits of u(i), x(i) is one of the state variant data which is produced in response to u(i), and $x_{INI}$ is a predetermined value.

In order to achieve still another aspect of the present invention, a display apparatus is composed of a pseudo gray level data processor generating pseudo gray level data having m bits based on input gray level data having n bits representative of an input gray level of $2^n$ gray levels, n being a natural number equal to or more than 2, and m being a natural number less than n. The pseudo gray level data processor includes a state variable generator, a subtracter, and a pseudo gray level generator. The state variable generator generates a state variable data having n−m bits, based on lower n−m bits of the input gray level data. The subtracter calculates a difference the lower n−m bits of the input gray level data minus the state variable data to output a carry bit representative of carry-over of the difference. The pseudo gray level data generator generating the pseudo gray level data on the basis of the input gray level data and the carry bit. In a third case when the carry bit is "1" and the input gray level belongs to second gray levels of the $2^n$ gray levels, the pseudo gray level data generator defines the pseudo gray level data such that the pseudo gray level data equals upper m bits of the input gray level data. In a fourth case when the carry bit is "0" and the input gray level data belongs to the second gray levels, the pseudo gray level data generator defines the pseudo gray level data such that upper m−1 bits of the pseudo gray level data equals upper m−1 bits of the input gray level data and LSB (least significant bit) of the pseudo gray level data is selected from "0" and "1".

In order to achieve still another aspect of the present invention, a method of generating pseudo gray level data representative of pseudo gray level is composed of:

sequentially inputting input gray level data, each of which has n bits and is representative of an input gray level of $2^n$ gray levels, n being a natural number equal to or more than 2, and sequentially generating pseudo gray level data having m bits based on the input gray level data, m being a natural number less than n. The sequentially generating includes:

delaying work data having n−m bits by a duration substantially equal to a temporal interval at which the input gray level data is inputted to output state variable data, calculating a sum of lower n−m bits of the input gray level data and the state variable data, outputting the sum as the work data, outputting a carry bit of the sum, defining the pseudo gray level data such that the pseudo gray level data equals upper m bits of the input gray level data in a first case when the carry bit is "0" and the input gray level belongs to first gray levels of the $2^n$ gray levels, and defining the pseudo gray level data such that upper m−1 bits of the pseudo gray level data equals upper m−1 bits of the input gray level data and LSB of the pseudo gray level data is selected from "0" and "1" in a second case when the carry bit is "1" and the input gray level data belongs to the first gray levels.

In order to achieve still another aspect of the present invention, a method of generating pseudo gray level data representative of pseudo gray level comprises:

sequentially inputting input gray level data, each of which has n bits and is representative of an input gray level of $2^n$ gray levels, n being a natural number equal to or more than 2, and sequentially generating pseudo gray level data having m bits based on the input gray level data, m being a natural number less than n. The sequentially generating includes:

delaying work data having n−m bits by a duration substantially equal to a temporal interval at which the input gray level data is inputted to output state variable data, calculating a difference lower n−m bits of the input gray level data minus the state variable data, outputting the difference as the work data, outputting a carry bit of the difference, defining the pseudo gray level data such that the pseudo gray level data equals upper m bits of the input gray level data in a first case when the carry bit is "0" and the input gray level belongs to first gray levels of the $2^n$ gray levels, and defining the pseudo gray level data such that upper m−1 bits of the pseudo gray level data equals upper m−1 bits of the input gray level data and LSB (least significant bit) of the pseudo gray level data is selected from "0" and "1" in a second case when the carry bit is "1" and the input gray level data belongs to the first gray levels.

BRIEF DESCRIPTION OF THE DRAWINGS

FIG. 4 shows order of input gray level data $u_r$ (i, j, k) inputted to the pseudo gray level processor 3;

FIG. 6 shows a content of an initial value determination ROM 35*a;*

FIG. 8 shows a correspondence between an input gray level data $u_r$ and a pseudo gray level data $y_r$, in the first embodiment;

FIG. 9 shows a process for generating a pseudo gray level data $y_{RA}$, is an Operation Example 1;

FIG. 10 shows a carry data $CRY_r$ and a least significant bit (LSB) $y_r^{LSB}$ in an Operation Example 2;

FIG. 11 shows a process for generating a pseudo gray level data $y_{RA}$, in Operation Example 2;

FIG. 12 shows a carry data $CRY_r$ and a LSB $y_r^{LSB}$ in Operation Example 2;

FIG. 14 shows a line combination pattern;

FIG. 17 shows a correspondence between an input gray level data $u_r$ and a pseudo gray level data $y_r$ in a second embodiment;

FIG. 20 shows a correspondence between an input gray level data $u_r$ and a pseudo gray level data $y_r$, in the third embodiment;

FIG. 21A shows $z_r$ (j, k);

FIG. 21B shows $z_r$ (j, k);

FIG. 22 shows a carry data $CRY_r$ and a LSB $y_r^{LSB}$, in Operation Example 3;

FIG. 23 shows a carry data $CRY_r$ and a LSB $y_r^{LSB}$ in Operation Example 4;

FIG. 25 shows a correspondence between an input gray level data $u_r$ and a pseudo gray level data $y_r$, when the pseudo gray level processor 13' is used.

DESCRIPTION OF THE PREFERRED EMBODIMENTS

A pseudo gray level processor and a display apparatus of an embodiment according to the present invention will be described below with reference to the attached drawings.

First Embodiment

Figure 1:
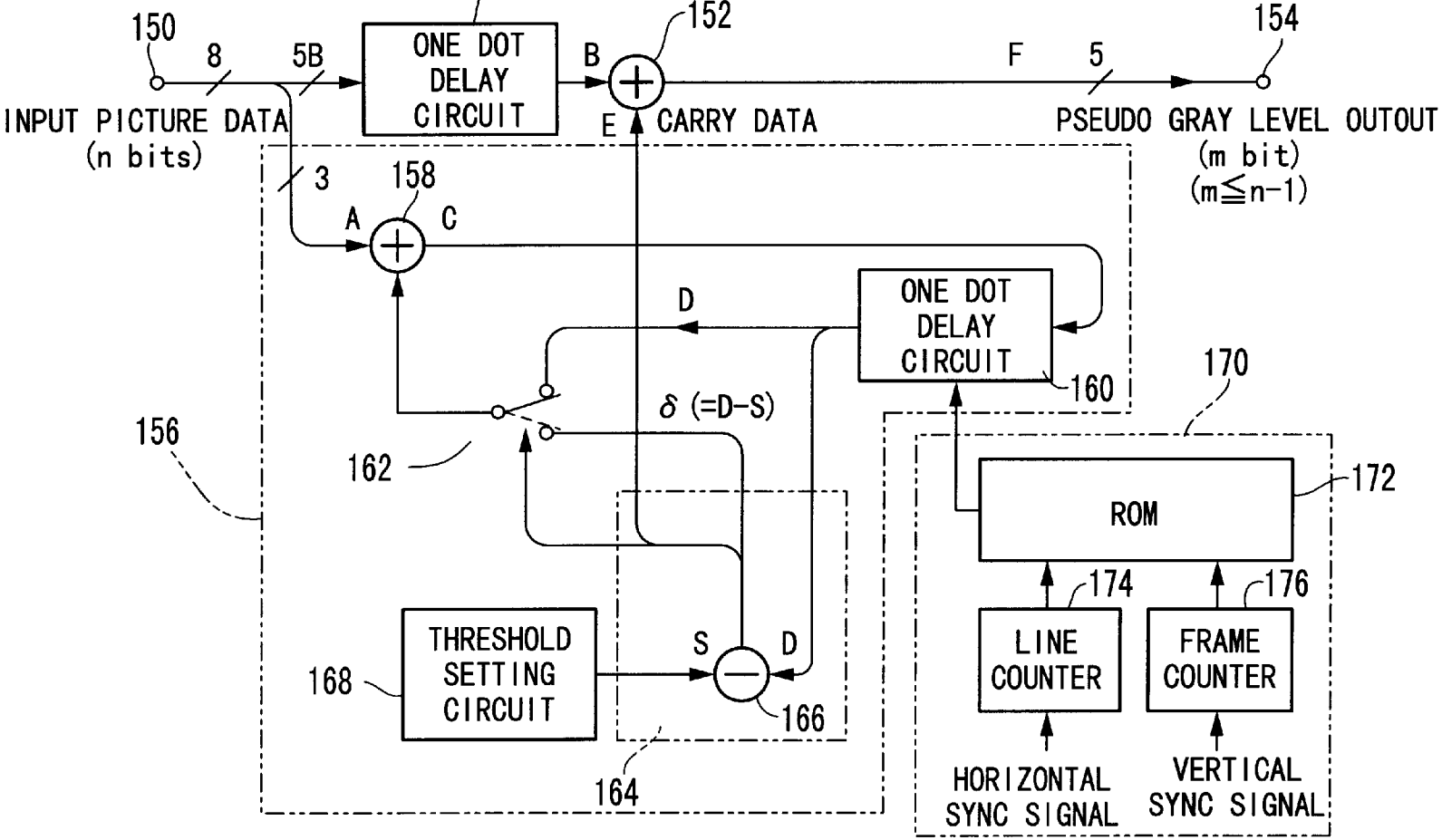
Fig. 1 PRIOR ART
FIG. 1 shows a conventional pseudo gray level processor.
Figure 2:
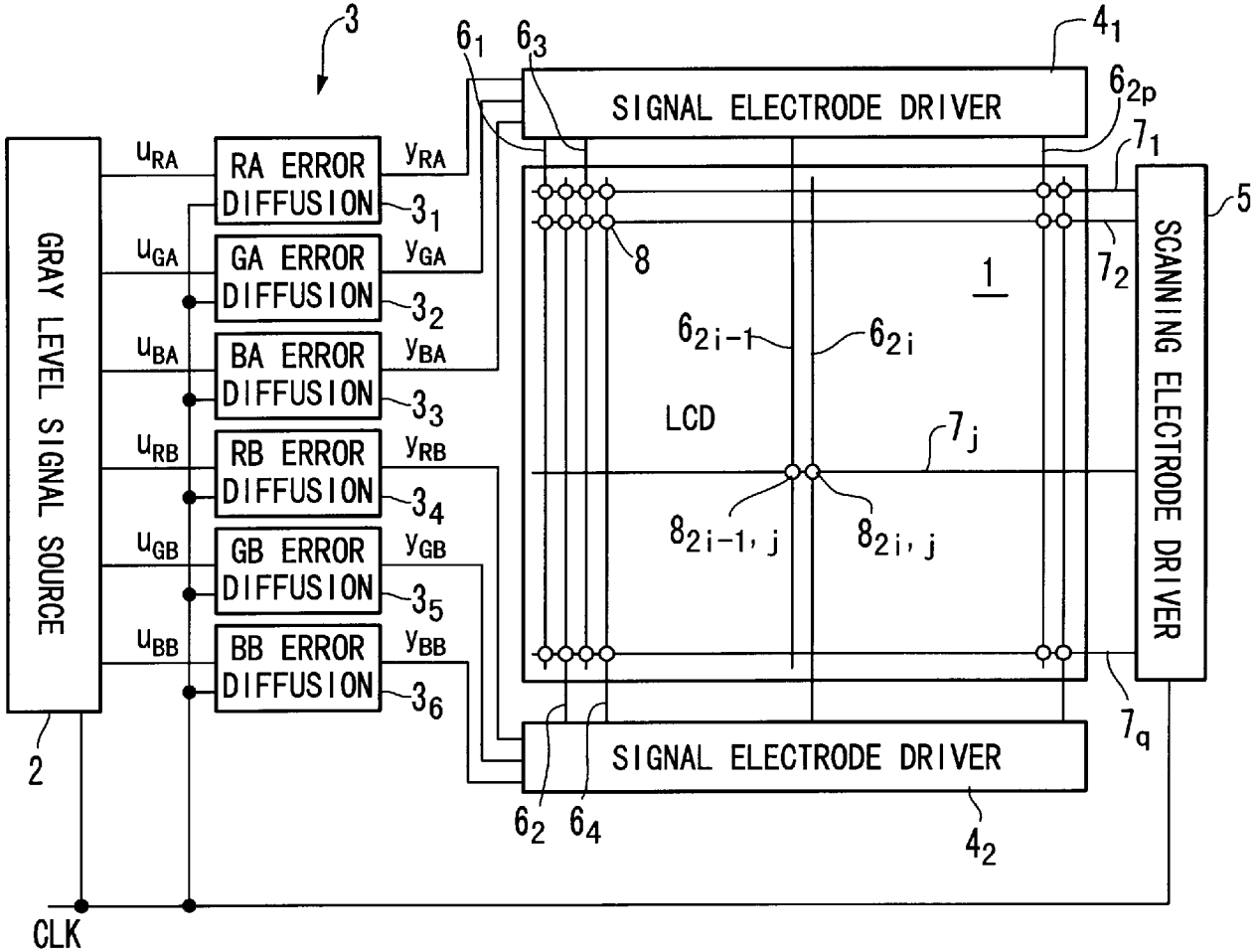
FIG. 2 shows a configuration of a display apparatus of an embodiment of the present invention.

FIG. 2 shows a display apparatus of a first embodiment according to the present invention. The display apparatus is provided with an LCD 1, a gray level signal source 2, pseudo gray level processors $\mathbf{3}_1$–$\mathbf{3}_6$, signal electrode drivers $\mathbf{4}_1$, $\mathbf{4}_2$ and a scanning electrode driving circuit 5. The pseudo gray level processors $\mathbf{3}_1$–$\mathbf{3}_6$ may be referred to as pseudo gray level processors 3.

The LCD 1 displays 2p×q dots, where both of p and q are natural numbers. The LCD 1 has 2p longitudinal lines $\mathbf{6}_1$–$\mathbf{6}_{2p}$ and q lateral lines $\mathbf{7}_1$–$\mathbf{7}_q$. Each of the longitudinal lines $\mathbf{6}_1$–$\mathbf{6}_{2p}$ includes an R signal line, a B signal line and a G signal line (not shown). Hereafter, in the specification, the longitudinal lines $\mathbf{6}_1$–$\mathbf{6}_{2p}$ may be referred to as longitudinal lines 6, and the lateral lines $\mathbf{7}_1$ to $\mathbf{7}_q$ may be totally to as lateral lines 7.

The LCD 1 has (2p×q) pixels 8. Each pixel 8 is connected to one of the longitudinal lines 6 and one of the lateral lines 7. Each of the pixels 8 is placed at a position at which longitudinal lines 6 and lateral lines 7 overlap. Hereinafter, a pixel placed at which a longitudinal line $\mathbf{6}_s$ and a lateral line $\mathbf{7}_t$ overlap is referred to as a pixel $\mathbf{8}_{s,t}$, in this specification where s is an integer between 1 and 2p, and t is an integer between 1 and q. The pixel $\mathbf{8}_{s,t}$ connected to the lateral line $\mathbf{7}_t$ is activated when the lateral line $\mathbf{7}_t$ is selected by the scanning electrode driving circuit 5. When the pixel $\mathbf{8}_{s,t}$ emits a light, a red brightness, a blue brightness and a green brightness there of are respectively determined by respective voltages of the R signal line, the B signal line and the G signal line contained in the longitudinal line $\mathbf{6}_s$ connected to the pixel $\mathbf{8}_{s,t}$.

The gray level signal source 2 generates input gray level data $u_{RA}$, $u_{GA}$, $u_{BA}$, $u_{RB}$, $u_{GB}$ and $u_{BB}$. All of the input gray level data $u_{RA}$, $u_{GA}$, $u_{BA}$, $u_{RB}$, $u_{GB}$ and $u_{BB}$ are n-bit data, and can represent $2^n$ gray levels. In this embodiment, n is assumed to be 8.

The input gray level data $u_{RA}$ specifies a gray level of red for a pixel $\mathbf{8}_{2i-1}$ connected to an odd-numbered longitudinal line $\mathbf{6}_{2i-1}$. Here, i is an integer between 1 and p. The input gray level data $u_{GA}$ specifies a gray level of green for the pixel $\mathbf{8}_{2i-1}$ connected to the odd-numbered longitudinal line $\mathbf{6}_{2i-1}$. And, the input gray level data $u_{BA}$ specifies a gray level of blue for the pixel $\mathbf{8}_{2i-}$connected to the odd-numbered longitudinal line $\mathbf{6}_{2i-}$.

The input gray level data $u_{RB}$ specifies a gray level of red for a pixel $\mathbf{8}_{2i}$ connected to an even-numbered longitudinal line. The input gray level data $u_{GA}$ specifies a gray level of green for the pixel $\mathbf{8}_{2i}$ connected to the even-numbered longitudinal line $\mathbf{6}_{2i}$. And, the input gray level data $u_{BA}$ specifies a gray level of blue for the pixel $\mathbf{8}_{2i}$ connected to the even-numbered longitudinal line $\mathbf{6}_{2i}$.

Two input gray level data is provided for each of red, green and blue, and this facilitates faster responding of the LCD 1. The signal processing of input gray level data for one color is distributed to two of pseudo gray level processors 3 and reduces the required processing speed for the pseudo gray level processors 3.

All of the input gray level data $u_{RA}$, $u_{GA}$, $u_{BA}$, $u_{RB}$, $u_{GB}$ and $u_{BB}$ are inputted to the pseudo gray level processors 3 in synchronous with a clock signal CLK. The gray level signal source 2 generates the input gray level data $u_{RA}$, $u_{GA}$, $u_{BA}$ representative of one gray level of the pixel 8 for each clock cycle of the clock signal CLK. In the same way, the gray level signal source 2 generates the input gray level data $u_{RB}$, $u_{GB}$, $u_{BB}$ indicative of the other gray level of the pixel 8 for each clock cycle of the clock signal CLK.

Figure 3:
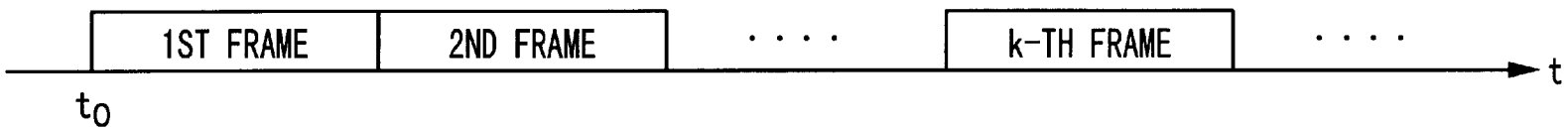
FIG. 3 shows order of frames.

The input gray level data $u_{RA}$ is generated as follows. A period while the LCD 1 displays a picture is divided into n frames as shown in FIG. 3. Each of the pixels 8 is turned on once a frame. In the following explanation, an element of the input gray level data $u_{RA}$ which is representative of a gray level in the k-th frame of a pixel $\mathbf{8}_{2i-1,j}$ is referred to as an input gray level data $u_{RA}$ (i, j, k).

The input gray level data $u_{RA}$ (i, j, k) are generated in the ascending order of the affix k. In the same frame, that is, for the same k, the input gray level data $u_{RA}$ (i, j, k) are generated in the ascending order of the affix j. Moreover, In the same lateral line, that is, for the same j, the input gray level data $u_{RA}$ (i, j, k) are generated in the ascending order of the affix i.

That is, as shown in FIG. 4, the input gray level data $u_{RA}$ (i, 1, 1) representative of gray levels of the pixels $\mathbf{8}_{2i-1,\,1}$ in a first frame are inputted in the ascending order of i. After the input of the input gray level data $u_{RA}$ (i, 1, 1), the input gray level data $u_{RA}$ (i, 2, 1) representative of gray levels of the pixels $\mathbf{8}_{i,\,2}$ are inputted. Hereafter, similarly, the input gray level data $u_{RA}$ (i, j, 1) representative of gray levels of pixels $\mathbf{8}_{2i-1,\,j}$ are inputted in turn. After the input gray level data $u_{RA}$ (i, j, 1), which are representative of the gray levels in all the pixels 8 in the first frame, other input gray level data $u_{RA}$ (i, j, k) representative of gray levels of a pixel $\mathbf{8}_{2i-1,\,j}$ in the successive frames are generated in turn.

Other input gray level data $u_{GA}$ and $u_{BA}$ are also generated in the same way as the input gray level data $u_{RA}$.

Also, an element of the input gray level data $u_{RB}$ which is representative of a gray level in a k-th frame of a pixel $\mathbf{8}_{2i,\,j}$ is hereafter referred to as an input gray level data $u_{RB}$ (i, j, k). The input gray level data $u_{RB}$ (i, j, k) is generated in the same order as the input gray level data $u_{RB}$ (i, j, k). That is, the input gray level data $u_{RB}$ (i, j, k) are generated in the ascending order of the affix k. For the same affix k, the input gray level data $u_{RB}$ (i, j, k) are generated in the ascending order of the affix k. For the same affixes j and k, the input gray level data $u_{RB}$ (i, j, k) are generated in the ascending order of the affix i.

Other input gray level data $u_{GB}$ and $u_{BB}$ are also generated in the same way as the input gray level data $u_{RB}$.

The generated input gray level data $u_{RA}$, $u_{GA}$, $u_{BA}$, $u_{RB}$, $u_{GB}$ and $u_{BB}$ are inputted to the pseudo gray level processors $\mathbf{3}_1$–$\mathbf{3}_6$ in the generated order, respectively.

The pseudo gray level processor $\mathbf{3}_1$ generates a pseudo gray level data $y_{RA}$ that is an m-bit data, from an input gray level data $u_{RA}$, which is an n-bit data. Similarly, the pseudo gray level processors $\mathbf{3}_2$, $\mathbf{3}_3$, $\mathbf{3}_4$, $\mathbf{3}_5$ and $\mathbf{3}_6$ generate pseudo gray level data $y_{GA}$, $y_{BA}$, $y_{RB}$, $y_{GB}$ and $y_{BB}$ that are respectively m-bit data, from input gray level data $u_{GA}$, $u_{BA}$, $u_{RB}$, $u_{GB}$ and $u_{BB}$ that are respectively n-bit data. In this embodiment, m is assumed to be 2. All of the pseudo gray level data $y_{RA}$, $y_{GA}$, $y_{BA}$, $y_{RB}$, $y_{GB}$ and $y_{BB}$ are generated synchronously with the clock signal CLK. The pseudo gray level data $y_{RA}$, $y_{GA}$, $y_{BA}$, $y_{RB}$, $y_{GB}$ and $y_{BB}$ respective of one gray level in the pixels 8 are generated for each clock cycle of the clock signal CLK.

Among the pseudo gray level data $y_{RA}$, $y_{GA}$ and $y_{BA}$, elements representative of gray levels in k-th frame of the pixel $\mathbf{8}_{2i-1,\,j}$ are hereafter referred to as pseudo gray level data $y_{RA}$ (i, j, k), $y_{GA}$ (i, j, k) and $y_{BA}$ (i, j, k), respectively.

Similarly, elements of pseudo gray level data $y_{RB}$, $y_{GB}$ and $y_{BB}$ which are representative of gray levels in k-th frame of the pixel $\mathbf{8}_{2i,\,j}$ are hereafter referred to as pseudo gray level data $y_{RB}$ (i, j, k), $y_{GB}$ (i, j, k) and $y_{BB}$ (i, j , k) respectively.

The pseudo gray level data $y_{RA}$, $y_{GA}$ and $y_{BA}$ are inputted to the signal electrode driver $\mathbf{4}_1$, as shown in FIG. 2.

The signal electrode driver $\mathbf{4}_1$ determines the voltages of the R signal line, the G signal line and the B signal line contained in the odd-numbered longitudinal lines 6 from the left side, on the basis of the pseudo gray level data $y_{RA}$, $y_{GA}$ and $y_{BA}$. The voltage of the R signal line of the longitudinal line $\mathbf{6}_{2i-1}$ is determined on the basis of the pseudo gray level data $y_{RA}$. The voltage of the G signal line of the longitudinal line $\mathbf{6}_{2i-1}$ is determined on the basis of the pseudo gray level data $y_{GA}$. The voltage of the B signal line of the longitudinal line $\mathbf{6}_{2i-1}$ is determined on the basis of the pseudo gray level data $y_{BA}$.

Also, the pseudo gray level data $y_{RB}$, $y_{GB}$ and $y_{BB}$ generated by the pseudo gray level processors $\mathbf{3}_4$–$\mathbf{3}_6$ are inputted to the signal electrode driver $\mathbf{4}_2$.

The signal electrode driver $\mathbf{4}_2$ determines the voltages of the R signal line, the G signal line and the B signal line contained in the even-numbered longitudinal lines $\mathbf{6}_{2i}$ from the left side, on the basis of the pseudo gray level data $y_{RB}$, $y_{GB}$ and $y_{BB}$. The voltage of the R signal line of the longitudinal line $\mathbf{6}_{2i}$ is determined on the basis of the pseudo gray level data $y_{RB}$. The voltage of the G signal line of the longitudinal line $\mathbf{6}_{2i}$ is determined on the basis of the pseudo gray level data $y_{GB}$. The voltage of the B signal line of the longitudinal line $\mathbf{6}_{2i}$ is determined on the basis of the pseudo gray level data $y_{BB}$.

The scanning electrode driving circuit 5 enables any of the longitudinal lines $\mathbf{7}_1$–$\mathbf{7}_p$ in synchronization with the clock signal CLK. The enable operation of the longitudinal lines $\mathbf{7}_1$–$\mathbf{7}_p$ is synchronous with the pseudo gray level data $y_{RA}$, $y_{GA}$, $y_{BA}$, $y_{RB}$, $y_{GB}$ and $y_{BB}$. That is, the longitudinal line $\mathbf{7}_j$ is enabled while the pseudo gray level data $y_{RA}$ (i, j, k), $y_{GA}$ (i, j, k), $y_{BA}$ (i, j, k), $y_{RB}$ (i, j, k), $y_{GB}$ (i, j, k) and $y_{BB}$ (i, j, k) representative of the gray levels of the pixels $\mathbf{8}_{2i-1,\,j}$ and $\mathbf{8}_{2i,\,j}$ are outputted by the pseudo gray level processors $\mathbf{3}_1$ to $\mathbf{3}_6$, and the pixel pixels $\mathbf{8}_{2i-1,\,j}$ and $\mathbf{8}_{2i,\,j}$ display the gray level indicated by the pseudo gray level data.

In the display apparatus, the pseudo gray level processors $\mathbf{3}_1$–$\mathbf{3}_6$ generate the pseudo gray level data $y_{RA}$, $y_{GA}$, $y_{BA}$, $y_{RB}$, $y_{GB}$ and $y_{BB}$ that are the m-bit data, respectively, from the input gray level data $u_{RA}$, $u_{GA}$, $u_{BA}$, $u_{RB}$, $u_{GB}$, $u_{BB}$ that are the n-bit data. The configuration and the operation of the pseudo gray level processors $\mathbf{3}_1$–$\mathbf{3}_6$ described below allows the pseudo gray level data $y_{RA}$, $y_{GA}$, $y_{BA}$, $y_{RB}$, $y_{GB}$ and $y_{BB}$ to be representative of all the $2^n$ gray levels.

Figure 5:
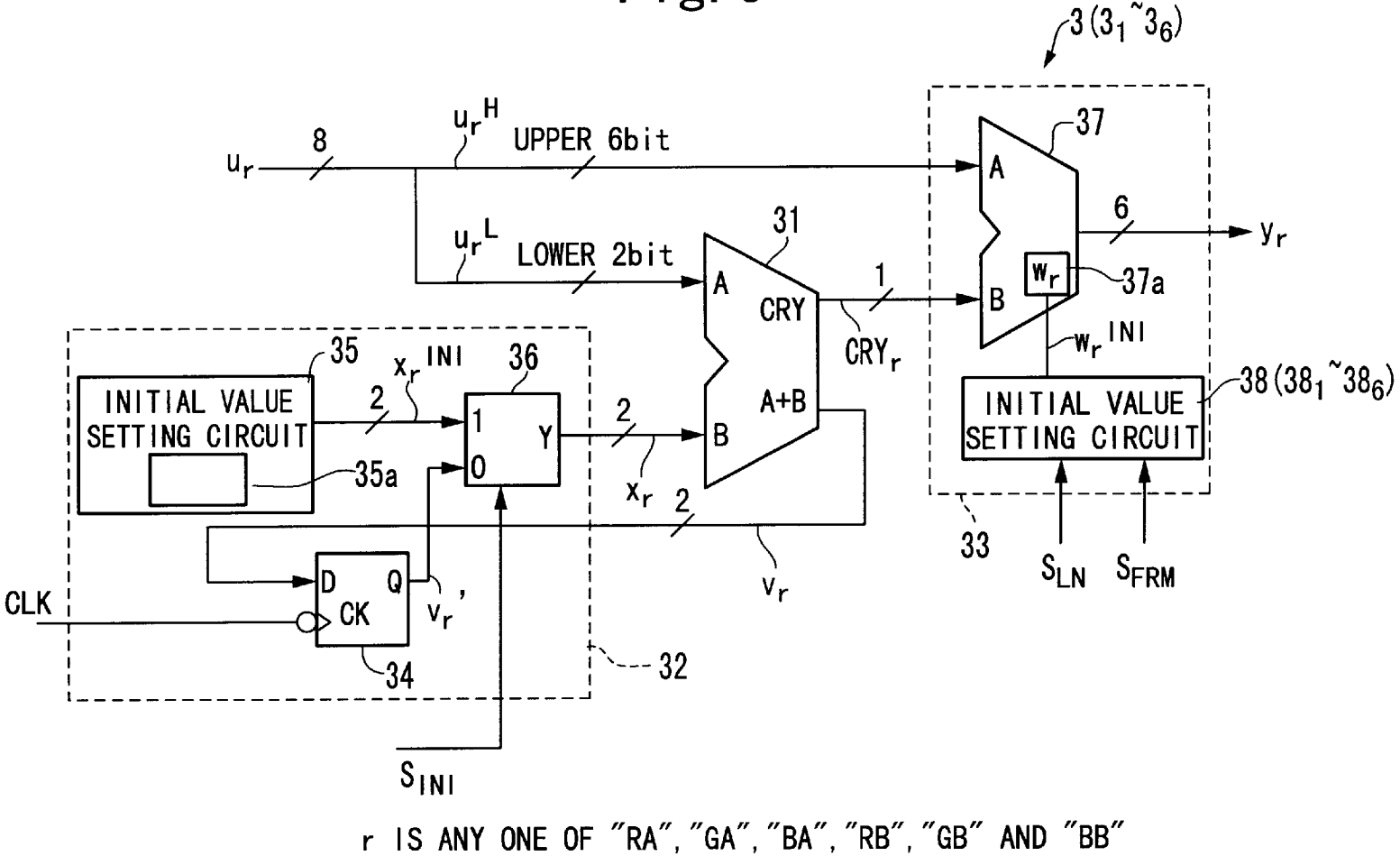
FIG. 5 shows a configuration of pseudo gray level processors 3.

The pseudo gray level processors 3 implement an improved error diffusion method for generating pseudo gray level data. FIG. 5 shows the configuration of the pseudo gray level processors 3. In FIG. 5 and the following, r is an affix implying any of "RA", "GA", "BA", "RB", "GB" and "BB". For r being "RA", FIG. 5 shows the configuration of the pseudo gray level processor $\mathbf{3}_1$. Similarly, For r being "GA", "BA", "RB", "GB" or "BB", FIG. 5 shows the configuration of the pseudo gray level processor $\mathbf{3}_2$, $\mathbf{3}_3$, $\mathbf{3}_4$, $\mathbf{3}_5$, or $\mathbf{3}_6$, respectively.

Each of the pseudo gray level processors $\mathbf{3}_1$–$\mathbf{3}_6$ includes an adder 31, a state variable data generator 32 and a pseudo gray level data calculator 33.

The adder 31 receives an (n−m)-bit state variable data $x_r$ (i, j, k) generated by the state variable data generator 32 and a lower bit data $u_r^L$ (i, j, k) which is the lower n−m bits of the input gray level data $u_r$ (i, j, k). Here, the state variable data $x_r$ (i, j, k) is generated correspondingly to the input gray level data $u_r$ (i, j, k). The adder 31 adds the state variable data $x_r$ (i, j, k) and the lower bit data $u_r^L$ (i, j, k) to generate an (n−m)-bit value $v_r$ (i, j, k).

That is, the value $v_r$ (i, j, k) is given by $$v_r(i, j, k)=x_r(i, j, k)+u_r^L(i, j, k).$$

The value $v_r$ (i, j, k) is inputted to the state variable data generator 32.

The state variable data generator 32 includes a D-flip-flop 34, an initial value setting circuit 35 and a switch 36. The D-flip-flop 34 delays the value $v_r$ (i, j, k) by one clock cycle in synchronization with the clock signal CLK to output a value data $v_r'$ (i, j, k), namely, $$v_r'(i, j, k)=v_r(i-1, j, k).$$

The initial value setting circuit 35 defines an initial state variable data $x_r^{INI}$. The initial state variable data $x_r^{INI}$ is defined independently for each of the lateral lines 7, and independently defined for each frame. In the initial state variable data $x_r^{INI}$, an element-defined for the lateral line $\mathbf{7}_j$ of the k-th frame is referred to as an initial state variable data $x_r^{INI}$ (j, k). Also, the initial state variable data $x_r^{INI}$ is independently defined for each of the pseudo gray level processors $\mathbf{3}_1$–$\mathbf{3}_6$. That is, the initial value setting circuits $\mathbf{35}_1$–$\mathbf{35}_6$ define the initial state variable data $x_r^{INI}$ independently of each other, where the initial value setting circuits 35 included in the pseudo gray level processors $\mathbf{3}_1$–$\mathbf{3}_6$ are referred to as initial value setting circuits $\mathbf{35}_1$–$\mathbf{35}_6$, respectively.

Each of the initial value setting circuit 35 includes initial value determining ROMs 35*a* for defining the initial state variable data $x_r^{INI}$ (j, k). In the initial value determiner ROMs 35*a*, respective elements included by the initial value setting circuits $\mathbf{35}_1$–$\mathbf{35}_6$ are referred to as initial value determiner ROMs $\mathbf{35}a_1$ to $\mathbf{35}a_6$, respectively.

FIG. 6 is a table illustrating the contents of the initial value determiner ROMs $\mathbf{35}a_1$ to $\mathbf{35}a_6$. A value "0" illustrated in the table of FIG. 6 implies that the initial state variable data $x_r^{INI}$ is "00". Similarly, values "1", "2" and "3" imply that the initial state variable data $x_r^{INI}$ are "01", "10" and "11", respectively.

Columns $\mathbf{40}_1$–$\mathbf{40}_6$ included in the table of FIG. 6 indicate the values of the initial state variable data $x_r^{INI}$ (j, k) defined when r is "RA", "GA", "BA", "RB", "GB" and "BB", respectively. That is, the columns $\mathbf{40}_1$–$\mathbf{40}_6$ indicate the contents of the initial value determiner ROMs $\mathbf{35}a_1$ to $\mathbf{35}a_6$, respectively.

The table shown in FIG. 6 includes rows $\mathbf{41}_1$–$\mathbf{41}_8$. The row $\mathbf{41}_1$ includes rows $\mathbf{41}_{1,1}$–$\mathbf{41}_{1,4}$. Similarly, the line $\mathbf{41}_\alpha$ includes rows $\mathbf{41}_{\alpha,1}$–$\mathbf{41}_{\alpha,4}$, where α is a natural number equal to or less than 8. The row $\mathbf{41}_{\alpha,\beta}$ indicates an initial state variable data $x_r^{INI}$ defined for the lateral line $\mathbf{7}_j$, which is j=4t+β of the k-th frame of k=8s+α. Here, s and t are integers equal to or greater than 0.

For example, let us consider an initial state variable data $x_{RA}^{INI}$ (1, 1) in a case when j=k=1. The initial state variable data $x_{RA}^{INI}$ (1, 1) is the initial state variable data $x_{RA}^{INI}$ (1, 1) defined for a lateral line $\mathbf{7}_1$ during the first frame. With reference to FIG. 6, the initial state variable data $x_{RA}^{INI}$ (1, 1) is set to "0" that is a value indicated for a column $\mathbf{40}_1$ and a row $\mathbf{41}_{1,1}$. For the other r, j and k, the initial value setting circuits $\mathbf{35}_1$–$\mathbf{35}_6$ refer to the initial value determiner ROMs $\mathbf{35}a_1$–$\mathbf{35}a_6$, respectively, and define the initial state variable data $x_{RA}^{INI}$ (j, k), $x_{GA}^{INI}$ (j, k), $x_{BA}^{INI}$ (j, k), $x_{RB}^{INI}$ (j, k), $x_{GB}^{INI}$ (j, k), $x_{BB}^{INI}$ (j, k), respectively. The method of determining the content of the initial value determiner ROM 35*a* will be described later in detail.

The switch 36 is responsive to an initial value data switching signal $S_{INI}$ for outputting the initial state variable data $x_r^{INI}$ or the value $v_r'$ as the above-mentioned state variable data $x_r$ as shown in FIG. 5. The initial value data switching signal $S_{INI}$ is set to "1", when an input gray level data $u_r$ representative of gray levels of a pixel $\mathbf{8}_{1,t}$ and a pixel $\mathbf{8}_{2,t}$ connected to two longitudinal lines $\mathbf{6}_1$, $\mathbf{6}_2$ located on a leftmost side is inputted, namely, in a case when i=1. The initial value data switching signal $S_{INI}$ is set to "0", when an input gray level data $u_r$ indicative of a gray level of a pixel 8 connected to another longitudinal line 6 is inputted, namely, in a case when i≧2.

The switch 36 outputs the initial state variable data $x_r^{INI}$ as the state variable data $x_r$, when the initial value data switching signal $S_{INI}$ is at "1", namely, in a case when i=1. The switch 36 outputs the value $v_r'$ as the state variable data $x_r$, when the initial value data switching signal $S_{INI}$ is at "0", namely, in a case of i≧2.

The state variable data $x_r$ is represented in the case when i=1, by $$x_r(i, j, k)=x_r^{INI}(j, k),$$

and is represented in the case when i≧2 by $$\begin{aligned} x_r(i, j, k) &= v_r'(i, j, k), \\ &= x_r(i-1, j, k), \\ &= x_r(i-1, j, k) + u_r^L(i-1, j, k). \end{aligned}$$

The state variable data generator 32 outputs the state variable data $x_r$ (i, j, k) to the adder 31.

As mentioned above, the adder 31 outputs the sum of the state variable data $x_r$ (i, j, k) and the lower bit data $u_r$ (i, j, k) as the value $v_r$ (i, j, k).

In addition, the adder 31 outputs one-bit carry data $CRY_r$ (i, j, k), on the basis of the sum of the state variable data $x_r$ (i, j, k) and the lower bit data $u_r^L$ (i, j, k). If the sum of the state variable data $x_r$ (i, j, k) and the lower bit data $u_r^L$ (i, j, k) is a number that can not be represented by the n−m bits, namely, if a carry-over is induced, the adder 31 sets the carry data $CRY_r$ (i, j, k) to "1" and outputs the carry data $CRY_r$ (i, j, k) to the pseudo gray level data calculator 33. On the other hand, when the carry-over is not induced, the adder 31 sets the carry data $CRY_r$ (i, j, k) to "0" to output to the pseudo gray level data calculator 33.

As mentioned above, the calculation for calculating the carry data $CRY_r$ (i, j, k) from the lower bit data $u_r^L$ (i, j, k) is generally referred to as a primary error diffusion calculation. The carry data $CRY_r$ (i, j, k) is inputted to the pseudo gray level data calculator 33.

The pseudo gray level data calculator 33 includes a calculator 37 and an initial value setting circuit 38. The calculator 37 includes a one-bit counter 37*a* storing a one-bit value $W_r$, which is any one of "1" and "0".

The initial value setting circuit 38 sets the value $W_r$ storing in the counter 37*a* to an initial value $W_r^{INI}$, for each input of the input gray level data $u_r$ (i, j, k) indicating the gray levels of the pixel $\mathbf{8}_{i,j}$ and the pixel $\mathbf{8}_{2,j}$, which are located on the left of the LCD 1. That is, the initial value setting circuit 38 sets the initial value $W_r^{INI}$ for each lateral line 7 and for each frame. The initial value setting circuit 38 recognizes for which frame and lateral line the inputted input gray level data $u_r$ indicating the gray level of the pixel 8 is inputted, on the basis of a line management signal $S_{LN}$ and a frame management signal $S_{FRM}$. That is, the initial value setting circuit 38 recognizes the affixes j and k on the basis of the line management signal $S_{LN}$ and the frame management signal $S_{FRM}$, and defines the initial value $W_r^{INI}$ on the basis of the affixes j, and k. Hereafter, in the initial value $W_r^{INI}$, an element defined for a lateral line $\mathbf{7}_j$ in a k-th frame is referred to as an initial value $W_r^{INI}$ (j, k).

In addition, the initial value setting circuit 38 defines the initial value $W_r^{INI}$ independently for each of the pseudo gray level processors $\mathbf{3}_1$–$\mathbf{3}_6$. That is, the initial value setting circuits $\mathbf{38}_1$–$\mathbf{38}_6$ define the initial values $W_r^{INI}$, independently of each other, where the initial value setting circuits 38 respectively included in the pseudo gray level processors $\mathbf{3}_1$–$\mathbf{3}_6$ are referred to as the initial value setting circuits $\mathbf{38}_1$–$\mathbf{38}_6$, respectively.

Figure 7:
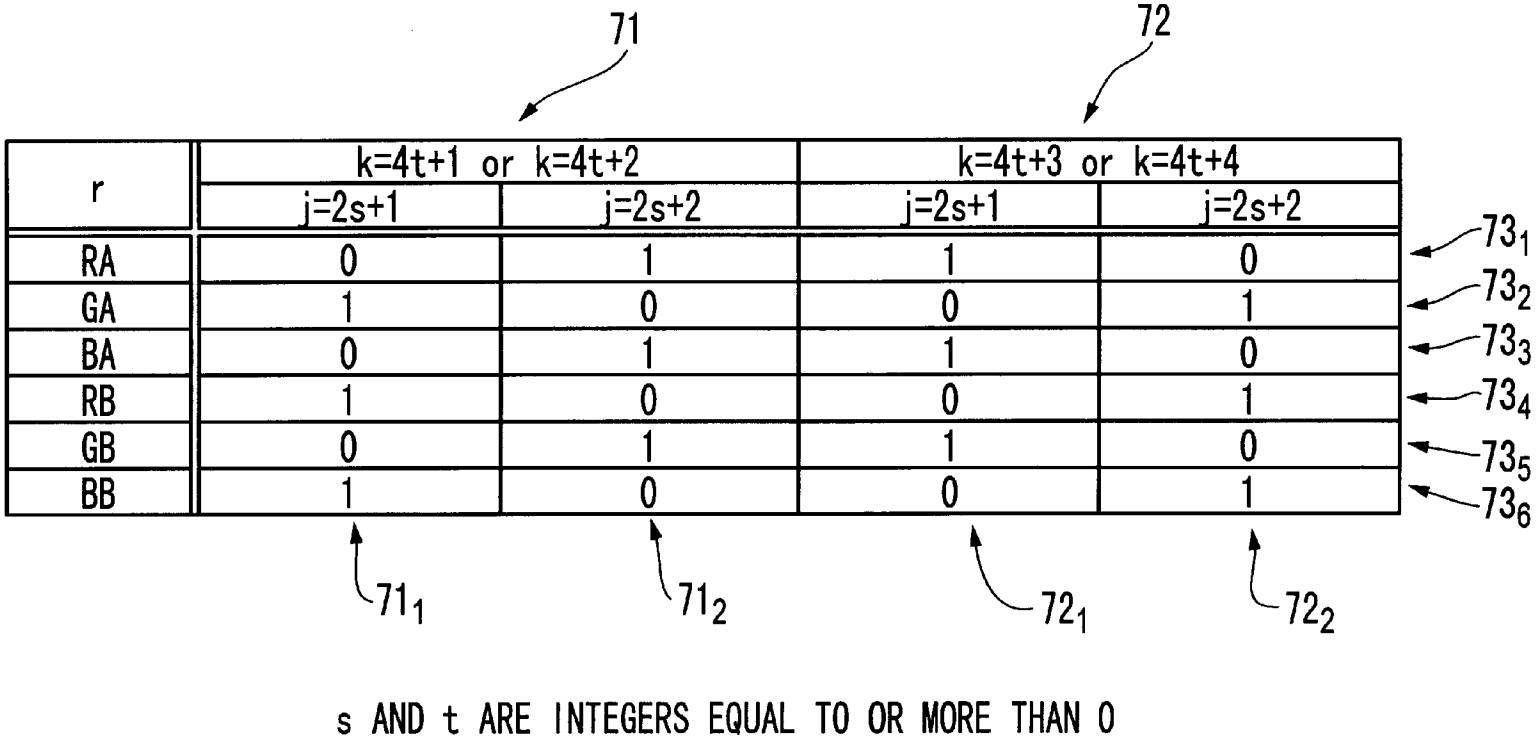
FIG. 7 shows an initial value $W_r^{INI}$.

The table of FIG. 7 shows the correspondence between r, j, k and the initial value $W_r^{INI}$ (j, k). A column 71 indicates the initial value $W_r^{INI}$ (j, k) in a case when k=4t+1, or 4t+2 (t is an integer of 0 or more). A column 72 indicates an initial value $W_r^{INI}$ (j, k) in a case when k=4t+3, or 4t+4. The column 71 includes a column $\mathbf{71}_1$ and a column $\mathbf{71}_2$. The column 72 includes a column $\mathbf{72}_1$ and a column $\mathbf{72}_2$. The column $\mathbf{71}_1$ and the column $\mathbf{72}_1$ show the initial value $W_r^{INI}$ (j, k) in a case when j=2s+1(s is an integer of 0 or more). The column $\mathbf{71}_2$ and the column $\mathbf{72}_2$ show the initial value $W_r^{INI}$ (j, k) in a case of j=2s+2 (s is an integer of 0 or more). On the other hand, rows $\mathbf{73}_1$–$\mathbf{73}_6$ indicate the initial values $W_r^{INI}$ (j, k) in the cases when r="RA", "RB", "BA", "RB", "GB" and "BB", respectively. For example, the initial value $W_r^{INI}$ (1,1), which is defined for the lateral line $\mathbf{7}_j$ of the first frame, is at "0" as shown in the column $\mathbf{71}_1$ and the row $\mathbf{73}_1$.

The calculator 33 generates a pseudo gray level data $y_r$ (i, j, k) on the basis of the input gray level data $u_r$ (i, j, k), the carry data $CRY_r$ (i, j, k) and the value $W_r$ stored in the counter 37*a*, as shown in FIG. 5.

FIG. 8 is a truth table of the pseudo gray level data $y_r$ (i, j, k) outputted by the calculator 37. Different calculations are carried out by the calculator 37 for Case 1–4 as described in the following.

Case 1

Case 1 is the case when at least one of the upper order (m−1) bits of the input gray level data $u_r$ (i, j, k) is at "0", that is, the case when $u_r$ (i, j, k) in the decimal notation is given by $$0 \leqq u_r(i, j, k) \leqq 2^n - 2^{(n-m+1)} - 1.$$

In this embodiment of n=8 and m=6, Case 1 is the case when $$0 \leqq u_r(i, j, k) \leqq 247.$$

In Case 1, the pseudo gray level data $y_r$ (i, j, k) is defined by:

$$y_r(i, j, k) = u_r^{H1}(i, j, k) + CRY_r(i, j, k),$$

where $u_r^{H1}$ (i, j, k) is upper m Bit of the input gray level data $u_r$ (i, j, k).

Case 2

Case 2 is the case when all of the upper (m−1) bits of the input gray level data $u_r$ (i, j, k) are at "1" and an m-th significant bit of the input gray level data $u_r$ (i, j, k) is at "0". In the embodiment of n=8 and m=6, Case 2 is the case when $$u_r^{H1}(i, j, k) = \text{"111110"}.$$

For the input gray level data $u_r$ (i, j, k) in the decimal notation, Case 2 is the case $$2^n - 2^{(n-m+1)} \leqq u_r(i, j, k) \leqq 2^n - 2^{(n-m)} - 1,$$

In this embodiment of n=8 and m=6, it holds $$248 \leqq u_r(i, j, k) \leqq 251.$$

Case 2 is further classified into the following two cases, depending on the carry data $CRY_r$ (i, j, k).

Case 2-1

Case 2-1 is the case when the carry data $CRY_r$ (i, j, k)="0". In Case 2-1, the pseudo gray level data $y_r$ (i, j, k) is defined by $$y_r(i, j, k) = u_r^{H1}(i, j, k),$$

where $u_r^{H1}$ (i, j, k) is the upper m bits of the input gray level data $u_r$ (i, j, k), as mentioned above. In this embodiment, pseudo gray level data $y_r$ (i, j, k) is defined by $$y_r(i, j, k) = \text{"111110"},$$

in Case 2-1.

Case 2-2

Case 2-2 is the case when the carry data $CRY_r$ (i, j, k)="1". In Case 2-2, the upper bit data $y_r^H$ (i, j, k) that is the upper (m−1) bits of the pseudo gray level data $y_r$ (i, j, k) is given by $$y_r^H(i, j, k) = u_r^{H2}(i, j, k),$$

where $u_r^{H2}$ (i, j, k) is the upper (m−1) bits of the input gray level data $u_r$ (i, j, k).

On the other hand, the LSB $y_r^{LSB}$ (i, j, k) of the pseudo gray level data $y_r$ (i, j, k) is defined by:

$$y_r^{LSB}(i, j, k) = W_r,$$

where $W_r$ is the value stored in the counter 37*a* as mentioned above. The value $W_r$ is toggled each time the LSB $y_r^{LSB}$ (i, j, k) is generated on the basis of the value $W_r$. That is, when "0" is stored as the value $W_r$ and the LSB $y_r^{LSB}$ (i, j, k) is generated on the basis of the value $W_r$, the stored value $W_r$ is then inverted to "1". Similarly, when "1" is held as the value $W_r$ and the LSB $y_r^{LSB}$ (i, j, k) is generated on the basis of the value $W_r$, the value $W_r$ is then inverted to "0".

When all the bits of the lower bit data $u_r^L$ (i, j, k) which is the lower (n−m) bits of the input gray level data $u_r$ (i, j, k) are at "0", the carry-over is never induced by the adding of the lower bit data $u_r^L$ (i, j, k) and the state variable data $x_r$ (i, j, k). In this embodiment of n=8 and m=6, it corresponds to the case when $$u_r(i, j, k) = \text{"11111000"}.$$

In FIG. 8, the fact that the carry-over is never induced is indicated by a symbol "–".

Case 3

Case 3 is the case when all of the upper m bits of the input gray level data $u_r$ (i, j, k) are at "1" and at least one of the lower (n−m) bits of the input gray level data $u_r$ (i, j, k) is at "0". In the embodiment of n=8 and m=6, Case 3 implies the case when $$u_r^{H1}(i, j, k) = \text{"111111"}, \text{ and}$$

$$u_r(i, j, k) \neq \text{"11111111"}.$$

For the input gray level data $u_r$ (i, j, k) in the decimal notation, Case 3 is the case when $$2^n - 2^{(n-m)} \leqq u_r(i, j, k) \leqq 2^n - 2.$$

In the embodiment of n=8 and m=6, it holds $$252 \leqq u_r(i, j, k) \leqq 254.$$

Case 2 is further classified into the following two cases, depending on the carry data $CRY_r$ (i, j, k).

Case 3-1

Case 3-1 is the case when the carry data $CRY_r$ (i, j, k) is "0". In Case 3-1, the upper bit data $y_r^H$ (i, j, k), which is the upper (m−1) bits of the pseudo gray level data $y_r$ (i, j, k) is given by $$y_r^H(i, j, k) = u_r^{H2}(i, j, k),$$

where, $u_r^{H2}$ (i, j, k) is the upper (m−1) bits of the input gray level data $u_r$ (i, j, k).

On the other hand, the LSB $y_r^{LSB}$ (i, j, k) of the pseudo gray level data $y_r$ (i, j, k) is given by $$y_r^{LSB}(i, j, k) = W_r.$$

where $W_r$ is the value stored in the counter 37*a*. The value $W_r$ is toggled each time the least significant bit data $y_r^{LSB}$ (i, j, k) is generated on the basis of the stored value $W_r$. Thus, the LSB $y_r^{LSB}$ (i, j, k) becomes at "0" at the rate of once every two times, and becomes at "1" at the rate of once every two times.

Case 3-2

Case 3-2 is the case when the carry data $CRY_r$ (i, j, k)="1". In Case 3-2, the pseudo gray level data $y_r$ (i, j, k) is defined by $$y_r(i, j, k) = u_r^{H1}(i, j, k),$$

where $u_r^{H1}$ (i, j, k) is the upper m bits of the input gray level data $u_r$ (i, j, k), as mentioned above. In this embodiment, the pseudo gray level data $y_r$ is given by:

$$y_r(i, j, k) = \text{"111111"}$$

When all the bits of the lower bit data $u_r^L$ (i, j, k) are at "0", the carry-over is never induced by the adding of the lower bit data $u_r^L$ (i, j, k) and the state variable data $x_r$ (i, j, k). In this embodiment of n=8 and m=6, it corresponds to the case when $$u_r(i, j, k)=\text{“11111100”}$$

In FIG. 8, the fact that the carry-over is never induced in the case of $u_r$ (i, j, k)=“11111100” is indicated by the symbol “–”.

Case 4

Case 4 is the case when all of the bits of the input gray level data $u_r$ (i, j, k) are at “1”. In the embodiment of n=8 and m=6, Case 4 is the case when $$u_r(i, j, k)=\text{“11111111”}.$$

For the input gray level data $u_r$ (i, j, k) in the decimal notation, Case 4 is the case when $$u_r(i, j, k)=2^n-1.$$

In Case 4, the pseudo gray level data $y_r$ is defined by $$y_r(i, j, k)=u_r^{H1}(i, j, k),$$

where $u_r^{H1}$ (i, j, k) is the upper m bits of the input gray level data $u_r$ (i, j, k). That is, in this embodiment, the pseudo gray level data $y_r$ is given by $$y_r(i, j, k)=\text{“111111”}.$$

The m-bit pseudo gray level data $y_r$ (i, j, k) generated by the pseudo gray level data calculator 33 can represent the $2^n$ gray levels. If the same process as the case 1 is performed for all of Case 1–4, that is, if the pseudo gray level data $y_r$ (i, j, k) is defined by $$y_r(i, j, k)=u_r^{H1}(i, j, k)+CRY_r(i, j, k),$$

it is impossible to indicate the $2^n$ gray levels by the pseudo gray level data $y_r$ (i, j, k). The above-mentioned conventional pseudo gray level processor, disclosed by Matsunaga et al. in Japanese Laid Open Patent Application, (JP-A-Heisei, 9-90902), allows to display only the 253 gray levels although the pseudo gray level processor is provided with gray level data representative of the 256 gray levels in the case when n=8 and m=6. The employment of the pseudo gray level processor according to the present invention enables the representation of the 256 gray levels.

Examples of the process for generating the pseudo gray level data $y_r$ (i, j, k) will be described below with regard to the input gray level data $u_r$ (i, j, k) being an actual value.

Operation Example 1

In Example 1, a process for generating the pseudo gray level data $y_r$ (i, j, k) is described for the case when the input gray level data $u_r$ (i, j, k) is given by $$u_r(i, j, k)=\text{“11111001”},$$

that is, $$u_r(i, j, k)=249.$$

This is Case 2 as mentioned above. Also, it is assumed that r is “RA”, that is, the process for generating a pseudo gray level data $y_{RA}$ (i, j, k) will be described in the following. FIG. 9 shows the state variable data $x_{RA}$, the value $v_{RA}$, the carry data $CRY_{RA}$, the value $W_{RA}$, the pseudo gray level data $y_{RA}$ to be finally generated, and its least significant bit $y_{RA}^{LSB}$. FIG. 9 shows $x_{RA}$, $v_{RA}$, $CRY_{RA}$, $W_{RA}$, $y_{RA}$ and $y_{RA}^{LSB}$ for i being an integer between 1 and 8. The operation of the pseudo gray level processors 3 will be described below with reference to FIG. 9.

Pixel $8_{1,1}$ During the First Frame (i=j=k=1)

At first, the initial state variable data $x_{RA}^{INI}$ (1, 1) and the initial value $W_{RA}^{INI}$ (1, 1) are defined. With reference to FIG. 6, the initial state variable data $x_{RA}^{INI}$ (1, 1) is given by $$x_{RA}^{INI}(1, 1)=\text{“00”}.$$

Also, with reference to FIG. 7, the initial value $W_{RA}^{INI}$ (1, 1) is given by:

$$W_{RA}^{INI}(1, 1)=\text{“0”}.$$

The value $W_{RA}$, which is stored in the counter 37*a*, is defined by $$W_{RA}=\text{“0”}.$$

The pseudo gray level data $y_{RA}$ (1, 1, 1) is defined as follows.

The input gray level data $u_{RA}$ (1, 1, 1), which is “11111001”, is inputted to the pseudo gray level processor $3_1$. Since i=1, the state variable data $x_{RA}$ (1, 1, 1) is defined as being the initial state variable data $x_{RA}^{INI}$ (1, 1) generated by the initial value setting circuit 35. That is, the state variable data $x_{RA}$ (1, 1, 1) is given by $$x_{RA}(1, 1, 1)=x_{RA}^{INI}(1, 1).$$

That is, as shown in FIG. 9, $$x_{RA}(1, 1, 1)=\text{“00”}.$$

A lower bit data $u_{RA}^L$ (1, 1, 1), which is lower two bits of the input gray level data $u_{RA}^L$ (1, 1, 1), is given by As shown in FIG. 9, The carry data $CRY_{RA}$ (1, 1, 1), which is a carry-over bit (carry bit) of the sum of the lower bit data $u_{RA}^L$ (1, 1, 1) and the state variable data $x_{RA}$ (1, 1, 1), is given by $$CRY_{RA}(1, 1, 1)=\text{“0”}.$$

The pseudo gray level data $y_{RA}$ (1, 1, 1) is defined in accordance with Case 2-1. That is, The pseudo gray level data $y_{RA}$ (1, 1, 1) is given by $$y_{RA}(1, 1, 1)=\text{“111110”}.$$

As shown in FIG. 9, the least significant bit $y_{RA}^{LSB}$ (1, 1, 1) is given by $$y_{RA}^{LSB}(1, 1, 1)=\text{“0”}.$$

In the meantime, the value $v_{RA}$ (1, 1, 1), which is the sum of the lower bit data $u_{RA}^L$ (1, 1, 1) and the state variable data $x_{RA}$ (1, 1, 1), is given by $$\begin{aligned} v_{RA}(1, 1, 1) &= x_{RA}(1, 1, 1)+u_{RA}^L(1, 1, 1) \\ &= \text{"01"}. \end{aligned}$$

Also, the value $W_{RA}$ is maintained in the original state. That is, for i being 2, the value $W_{RA}$ is given by $$W_{RA}=\text{“0”}.$$

Pixel $8_{3,1}$ During the First Frame (i=2, j=k=1)

The pseudo gray level data $y_{RA}$ (2, 1, 1) is defined as follows.

An input gray level data $u_{RA}$ (2, 1, 1), which is "11111001", is inputted to the pseudo gray level processor $3_1$. Since i=2, the state variable data $x_{RA}$ (2, 1, 1) is given by:

$$x_{RA}(2, 1, 1) = v_{RA}(1, 1, 1) = \text{"01"}.$$

For $u_{RA}^{L}$ (2, 1, 1) being "01", the carry data $CRY_{RA}$ (2, 1, 1), which is the carry-over bit (carry bit) of the sum of the lower bit data $u_{RA}^{L}$ (2, 1, 1) and the state variable data $x_{RA}$ (2, 1, 1), is given by $$CRY_{RA}(2, 1, 1)=\text{"0"}.$$

The pseudo gray level data $y_{RA}$ (2, 1, 1) is defined in accordance with Case 2-1. The pseudo gray level data $y_{RA}$ (2, 1, 1) is given by $$y_{RA}(2, 1, 1)=\text{"111110"}.$$

As shown in FIG. 9, the least significant bit $y_{RA}^{LSB}$ (2, 1, 1) is given by $$y_{RA}(2, 1, 1)=\text{"0"}.$$

In the meantime, a value $v_{RA}$ (2, 1, 1) is given by $$v_{RA}(2, 1, 1) = x_{RA}(2, 1, 1) + u_{RA}^{L}(2, 1, 1) = \text{"10"}.$$

Also, the value $W_{RA}$ is maintained in its original state. Therefore, for i being 3, the value $W_{RA}$ is given by $$W_{RA}=\text{"0"}.$$

Pixel $8_{5,\ 1}$ During the First Frame (i=3, j=k=1)

In the same way of the pixel $8_{3,\ 1}$, the state variable data $x_{RA}$, the carry data $CRY_{RA}$, the pseudo gray level data $y_{RA}$, and the LSB $y_{RA}^{LSB}$ are given by:

$$x_{RA}(3, 1, 1)=\text{"10"},$$

$$CRY_{RA}(3, 1, 1)=0,$$

$$y_{RA}(3, 1, 1)=\text{"111110"},$$

$$y_{RA}^{LSB}(3, 1, 1)=\text{"0"}, \text{ and}$$

$$v_{RA}(3, 1, 1)=\text{"11"}.$$

Also, the value $W_{RA}$ is maintained in its original state. For i being 4, the value $W_{RA}$ is given by $$W_{RA}=\text{"0"}.$$

Pixel $8_{7,\ 1}$ During the First Frame (i=4, j=k=1)

In the same way, the state variable data $x_{RA}$ (4, 1, 1) is given by $$x_{RA}(4, 1, 1) = v_{RA}(3, 1, 1) = \text{"11"}.$$

For $u_{RA}^{L}$ (4, 1, 1) being "01", a carry-over is induced when the state variable data $x_{RA}$ (4, 1, 1) and the lower bit $u_{RA}^{L}$ (4, 1, 1) are summed. As shown in FIG. 9, the carry data $CRY_{RA}$ (4, 1, 1) is given by $$CRY_{RA}(4, 1, 1)=\text{"1"}.$$

In the meantime, the pseudo gray level data $y_{RA}$ (4, 1, 1) is defined in accordance with the case 2-2. As shown in FIG. 9, the pseudo gray level data $y_{RA}$ (4, 1, 1) is given by $$y_{RA}^{H}(4, 1, 1)=\text{"11111"},$$

$$y_{RA}^{LSB}(4, 1, 1)=W_{RA},$$

where $y_{RA}^{H}$ (4, 1, 1) is the upper m−1 bits of the pseudo gray level data $y_{RA}$ (4, 1, 1), and $y_{RA}^{LSB}$ (4, 1, 1) is the LSB of $y_{RA}$(4, 1, 1). Since $W_{RA}$=0, as shown in FIG. 9, $y_{RA}^{LSB}$ (4, 1, 1) is given by $$y_{RA}^{LSB}(4,1,1)=\text{"0"}.$$

Once the LSB $y_{RA}^{LSB}$ is defined in accordance with the value $W_{RA}$ stored in the counter 37*a,* the value $W_{RA}$ is toggled. That is, the value $W_{RA}$ is toggled for each state of the case 2-2 or the case 3-1. In a case of i=5, as shown in FIG. 9, the value $W_{RA}$ is given by $$W_{RA}=\text{"1"}.$$

In the meantime, a value $v_{RA}$ (4, 1, 1) is given by $$v_{RA}(4, 1, 1) = x_{RA}(4, 1, 1) + u_{RA}^{L}(4, 1, 1) = \text{"00"}.$$

Pixels $8_{9,\ 1}$, $8_{11,\ 1}$ and $8_{13,\ 1}$ During the First Frame (5≦i≦7, j=k=1)

In all cases when 5≦i≦7, the pseudo gray level data $y_{RA}$ (i, 1, 1) is calculated in accordance with Case 2-1, and the pseudo gray level data $y_{RA}$ (i, 1, 1) and the LSB thereof are given by $$y_{RA}(i, 1, 1)=\text{"111110"},$$

$$y_{RA}^{LSB}(i, 1, 1)=\text{"0"}.$$

The values $v_{RA}$ (i, 1, 1) for i being 5 to 7 are similarly given by $$v_{RA}(5, 1, 1)=\text{"01"},$$

$$v_{RA}(6, 1, 1)=\text{"10"},$$

$$v_{RA}(7, 1, 1)=\text{"11"}.$$

Also, all the cases when i=5 to 7 do not correspond to any one of Case 2-2 and Case 3-1. Thus, the value $W_{RA}$ is maintained in its original state. That is, in a case of i=8, the value $W_R$ is given by $$W_{RA}=\text{"1"}.$$

Pixel $8_{15,\ 1}$ During the First Frame (i=8, j=k=1)

A state variable data $x_{RA}$ (8, 1, 1) is similarly given by $$x_{RA}(8, 1, 1) = v_{RA}(7, 1, 1) = \text{"11"}.$$

Since $u_{RA}^{L}$ (8, 1, 1)="01", a carry-over is induced when the state variable data $x_{RA}$ (8, 1, 1) and a lower bit $u_{RA}^{L}$ (8, 1, 1) are summed. As shown in FIG. 9, the carry data $CRY_{RA}$ (8, 1, 1) is given by $$CRY_{RA}(8, 1, 1)=\text{"1"}.$$

In the meantime, the pseudo gray level data $y_{RA}$ (8, 1, 1) is defined in accordance with Case 2-2. That is, as shown in FIG. 8, the pseudo gray level data $y_{RA}$ (8, 1, 1) is given by:

$$y_{RA}^{H}(8, 1, 1)=\text{“11111”},$$

$$y_{RA}^{LSB}(8, 1, 1)=W_{RA}.$$

Since $W_{RA}$=“1” as shown in FIG. 9, the LSB of the pseudo gray level data $y_{RA}$ (8, 1, 1) is given by:

$$y_{RA}(8, 1, 1)=\text{“1”}.$$

Once the LSB $y_{RA}^{LSB}$ is defined in accordance with the value $W_{RA}$, the value $W_{RA}$ is toggled. Therefore, the value $W_{RA}$ is given by:

$$W_{RA}=\text{“0”}$$

Hereafter, similarly, each time the input gray level data $u_{RA}$ and the carry data $CRY_{RA}$ correspond to Case 2-2 or Case 3-1, the LSB $y_{RA}^{LSB}$ alternately repeats “0” and “1”.

For other r and j, the LSB $y_{RA}^{LSB}$ and the carry data $CRY_r$ (i, j, k) are similarly defined. FIG. 10 shows the LSB $y_r^{LSB}$ (i, j, 1) of a pseudo gray level data $y_r$ (i, j, 1) and the carry data $CRY_r$ (i, j, 1) during the first frame in a case when $u_r$ (i, j, k)=“11111001”. In FIG. 10, values “0” and “1” indicate that the carry data $CRY_r$ (i, j, 1) are at “0” and “1”, respectively. Also, the fact that the “0”s and “1”s are hatched implies that the LSBs $y_r^{LSB}$ (i, j, 1) are at “1”. Moreover, the fact that the “0”s and “1”s are not hatched implies that the LSB $y_r^{LSB}$ (i, j, 1) are at “0”.

The case when $u_r$ (i, j, k)=“11111001” corresponds to Case 2, as mentioned above. A combination of i and j in which the carry data $CRY_r$ (i, j, 1) is at “0” corresponds to Case 2-1. In this case, the pseudo gray level data $y_r$ is given by:

$$y_r^{LSB}(i, j, 1)=\text{“111110”}$$

That is, the LSB $y_r^{LSB}$ is given by:

$$y_r^{LSB}(, j, 1)=\text{“0”}$$

On the other hand, a combination of i and j in which the carry data $CRY_r$ (i, j, 1) is at “1” corresponds to Case 2-2. In this case, The LSB $y_r^{LSB}$ alternately repeats “0” and “1” each time the $CRY_r$ (i, j, 1) is at “1”.

For example, let us consider the case of r=“RA” and j=1. The carry data $CRY_{RA}$ is at “1” in a case when i is 4 or 8. At the time of i being 4, the LSB $y_r^{LSB}$ (4, 1, 1) is at “1”. At the time of I being 8, the LSB $y_r^{LSB}$ (8, 1, 1) is at “0”. In another r and j, the same operation is executed.

Operation Example 2

In Operational Example 2, a process for generating the pseudo gray level data $y_r$ (i, j, k) is described for the case when the input gray level data $u_r$ (i, j, k) is given by $$u_r(i, j, k)=\text{“11111110”},$$

that is, $$u_r(i, j, k)=254,$$

The case when $u_r$ (i, j, k)=“11111110” corresponds to Case 3. Also, it is assumed that r is “RA”, that is, the process for generating a pseudo gray level data $y_{RA}$ (i, j, k) will be described in the following. FIG. 11 shows the state variable data $x_{RA}$, the value $v_{RA}$ and the carry data $CRY_{RA}$, the value $W_{RA}$, the pseudo gray level data $y_{RA}$ to be finally generated; and the LSB $y_{RA}^{LSB}$. FIG. 11 shows $x_{RA}$, $v_{RA}$, $CRY_{RA}$, $W_{RA}$, $y_{RA}$ and $y_{RA}^{LSB}$ when i is an integer between 1 and 8. The operation of the pseudo gray level processors 3 will be described below with reference to FIG. 11.

Pixel $8_{1,\ 1}$ During the First Frame (i=j=k=1)

At first, the initial state variable data $x_{RA}^{INI}$ (1, 1) and the initial value $W_{RA}^{INI}$ (1, 1) are defined. With reference to FIG. 6, the initial state variable data $x_{RA}^{INI}$ (1, 1) is given by $$x_{RA}^{INI}(1, 1)=\text{“00”}.$$

Also, with reference to FIG. 7, the initial value $W_{RA}^{INI}$ (1, 1) is given by $$W_{RA}^{INI}(1, 1)=\text{“0”}.$$

The value $W_{RA}$ is defined by $$W_{RA}=\text{“0”}$$

The pseudo gray level data $y_{RA}$ (1, 1, 1) is defined as follows.

The input gray level data $u_{RA}$ (1, 1, 1), which is “11111110”, is inputted to the pseudo gray level processor $3_1$. Since i=1, the state variable data $x_{RA}$ (1, 1, 1) is defined as being the initial state variable data $x_{RA}^{INI}$ (1, 1) generated by the initial value setting circuit 35. That is, the state variable data $x_{RA}$ (1, 1, 1) is given by $$\begin{aligned} x_{RA}(1, 1, 1) &= x_{RA}^{INI}(1, 1) \\ &= \text{"00"}. \end{aligned}$$

A lower bit data $u_{RA}^{L}$ (1, 1, 1), which is lower two bits of the input gray level data $u_{RA}^{L}$ (1, 1, 1), is given by $$u_{RA}^{L}(1, 1, 1)=\text{“10”}.$$

The carry data $CRY_{RA}$ (1, 1, 1), which is the carry-over bit (carry bit) of the sum of the lower bit data $u_{RA}^{L}$ (1, 1, 1) and the state variable data $x_{RA}$ (1, 1, 1), is given by $$CRY_{RA}(1, 1, 1)=\text{“0”},$$

The pseudo gray level data $y_{RA}$ (1, 1, 1) is defined in accordance with Case 3-1. That is, as shown in FIG. 8, The pseudo gray level data $y_{RA}$ (1, 1, 1) is given by:

$$y_{RA}^{H}(1, 1, 1)=\text{“11111”}$$

$$y_{RA}^{LSB}(1, 1, 1)=W_{RA}$$

Since $W_{RA}$=“0”, as shown in FIG. 11, the LSB $y_{RA}^{LSB}$ of the pseudo gray level data $y_{RA}$ is given by:

$$y_{RA}^{LSB}(1, 1, 1)=\text{“0”}$$

Once the least significant bit $y_{RA}^{LSB}$ is defined in accordance with the value $W_{RA}$, the value $W_{RA}$ is toggled. That is, the value $W_{RA}$ is toggled for each state of Case 2-2 or Case 3-1. For i being equal to or more than 2, the value $W_{RA}$ is given by:

$$W_{RA}=\text{“1”}.$$

Next, when the LSB $y_{RA}^{LSB}$ is defined on the basis of the value $W_{RA}$, and $$y_{RA}^{LSB}=\text{“1”}.$$

In the meantime, the value $v_{RA}$ (1, 1, 1) is given by $$v_{RA}(1, 1, 1) = x_{RA}(1, 1, 1) + u_{RA}^{L}(1, 1, 1) = \text{"10"}.$$

Pixel $8_{3,\ 1}$ During the First Frame (i=2, j=k=1)

The pseudo gray level data $y_{RA}$ (2, 1, 1) is defined as follows. The input gray level data $u_{RA}$ (2, 1, 1), which is "11111001", is inputted to the pseudo gray level processor $\mathbf{3}_1$. Since i=2, the state variable data $x_{RA}$ (2, 1, 1) is given by $$x_{RA}(2, 1, 1) = v_{RA}(1, 1, 1) = \text{"10"}.$$

Also, since $u_{RA}{}^{L}$ (2, 1, 1)="10", the sum of the lower bit data $u_{RA}{}^{L}$ (2, 1, 1) and the state variable data $x_{RA}$ (2, 1, 1) leads to the generation of the carry-over. The carry data $CRY_{RA}$ (2, 1, 1), which is the carry-over bit (carry bit), is given by $$CRY_{RA}(2, 1, 1)=\text{"1"}.$$

The pseudo gray level data $y_{RA}$ (2, 1, 1) is defined in accordance with Case 3-2. That is, as shown in FIG. 8, the pseudo gray level data $y_{RA}$ (2, 1, 1) is given by $$y_{RA}(2, 1, 1)=\text{"111111"}.$$

That is, the LSB $y_{RA}{}^{LSB}$ (2, 1, 1) is given by $$y_{RA}{}^{LSB}(2, 1, 1)=\text{"1"}.$$

On the other hand, the value $v_{RA}$ (2, 1, 1) is given by $$v_{RA}(2, 1, 1) = x_{RA}(2, 1, 1) + u_{RA}^{L}(2, 1, 1) = \text{"00"}.$$

Pixel $\mathbf{8}_{5,\ 1}$ of First Frame (i=3, j=k=1)

A pseudo gray level data $y_{RA}$ (3, 1, 1) is defined as follows. An input gray level data $u_{RA}$ (4, 1, 1), which is "11111001", is inputted to the pseudo gray level processor $\mathbf{3}_1$. The state variable data $x_{RA}$ (3, 1, 1) is given by $$x_{RA}(3, 1, 1) = v_{RA}^{INI}(2, 1, 1) = \text{"00"}.$$

A lower bit data $u_{RA}{}^{L}$ (3, 1, 1), which is lower two bits of the input gray level data $u_{RA}{}^{L}$ (3, 1, 1), is given by $$u_{RA}{}^{L}(3, 1, 1)=\text{"10"}.$$

As shown in FIG. 11, the carry data $CRY_{RA}$ (3, 1, 1), which is the carry-over bit (carry bit) of the sum of the lower bit data $u_{RA}{}^{L}$ (3, 1, 1) and the state variable data $x_{RA}$ (3, 1, 1), is given by $$CRY_{RA}(1, 1, 1)=\text{"0"}.$$

The pseudo gray level data $y_{RA}$ (3, 1, 1) is defined in accordance with Case 3-1. That is, as shown in FIG. 8, the pseudo gray level data $y_{RA}$ (3, 1, 1) are given by $$y_{RA}{}^{H}(3, 1, 1)=\text{"11111"}$$

$$y_{RA}{}^{LSB}(3, 1, 1)=W_{RA}$$

Since $W_{RA}$="1", as shown in FIG. 11, the LSB of pseudo gray level data $y_{RA}$ (3, 1, 1) is given by $$y_{RA}{}^{LSB}(3, 1, 1)=\text{"1"}.$$

Once the LSB $y_{RA}{}^{LSB}$ is defined in accordance with the value $W_{RA}$, the value $W_{RA}$ is toggled. For i being 4 or more, the value $W_{RA}$ is given by $$W_{RA}=\text{"0"}.$$

On the other hand, the value $v_{RA}$ (3, 1, 1) is given by $$v_{RA}(3, 1, 1) = x_{RA}(3, 1, 1) + u_{RA}^{L}(3, 1, 1) = \text{"10"}.$$

Pixel $8_{7,\ 1}$ of First Frame (i=4, j=k=1)

The pseudo gray level data $y_{RA}$ (4, 1, 1) is defined as follows. The input gray level data $u_{RA}$ (4, 1, 1), which is "11111001", is inputted to the pseudo gray level processor $\mathbf{3}_1$. The state variable data $x_{RA}$ (4, 1, 1) is given by $$x_{RA}(4, 1, 1) = v_{RA}(3, 1, 1) = \text{"10"}.$$

Also, since $u_{RA}{}^{L}$ (4, 1, 1)="10", the sum of the lower bit data $u_{RA}{}^{L}$ (4, 1, 1) and the state variable data $x_{RA}$ (4, 1, 1) leads to a carry-over. The carry data $CRY_{RA}$ (4, 1, 1), which is the carry-over bit (carry bit), is given by $$CRY_{RA}(4, 1, 1)=\text{"1"}.$$

The pseudo gray level data $y_{RA}$ (4, 1, 1) is defined in accordance with the case 3-2. That is, as shown in FIG. 8, the pseudo gray level data $y_{RA}$ (4, 1, 1) is given by $$y_{RA}(4, 1, 1)=\text{"111111"}.$$

As shown in FIG. 11, the LSB $y_{RA}{}^{LSB}$ (4, 1, 1) is given by $$y_{RA}{}^{LSB}(4, 1, 1)=\text{"1"}.$$

On the other hand, the value $v_{RA}$ (4, 1, 1) is given by $$v_{RA}(4, 1, 1) = x_{RA}(4, 1, 1) + u_{RA}^{L}(4, 1, 1) = \text{"00"}.$$

For other r, j, and k, the LSB $y_{RA}{}^{LSB}$ and the carry data $CRY_r$ (i, j, k) are defined in the same way.

FIG. 12 shows the least significant bit $y_r{}^{LSB}$ (i, j, 1) and the carry data $CRY_r$ (i, j, k) during the first frame in the case when $u_r$ (i, j, k)="11111110". As for FIG. 12, similarly to FIG. 10, the values "0" and "1" indicate that the carry data $CRY_r$ (i, j, 1) are at "0" and "1", respectively. Also, in FIG. 12, the fact that the values "0" and "1" are hatched implies that the least significant bit $y_r{}^{LSB}$ (i, j, 1) is at "1". Moreover, the fact that the values "0" and "1" are not hatched implies that the LSB $y_r{}^{LSB}$ (i, j, 1) is "0". The operation of the pseudo gray level processors 3 will be described below with reference to FIG. 12.

The case when $u_r$ (i, j, k)="11111110" corresponds to Case 3, as mentioned above. The combination of i and j in which the carry data $CRY_r$ (i, j, 1 ) is at "0" corresponds to Case 3-1. In this case, the LSB $y_r{}^{LSB}$ alternately repeats "0" and "1" each time the carry data $CRY_r$ (i, j, 1) is at "0".

For example, let us consider the case when r="RA" and j=1. The carry data $CRY_{RA}$ is at "0" in the case when i=1, 3, 5, 7 . . . In the case when i=1, 5, the LSB $y_r^{LSB}$ (4, 1, 1) is at "1". In the case when i=3, 7, the LSB $y_r^{LSB}$ (8, 1, 1) is at "0". In this way, the LSB $y_r^{LSB}$ (8, 1, 1) alternately repeats "0" and "1" each time the $CRY_r$ (i, j, 1) is at "0". For other r and j, the same operation is executed.

On the other hand, the combination of i and j in which the carry data $CRY_r$ (i, j, 1) is at "1" corresponds to Case 3-2. In this case, the pseudo gray level data $y_r$ is given by $$y_r(i, j, 1)=\text{"111111"}$$

That is, the LSB bit $y_r^{LSB}$ is given by:

$$y_r^{LSB}(i, j, 1)=\text{"1"}.$$

As mentioned above, the voltage applied to each pixel 8 is determined on the basis of the pseudo gray level data $y_r$. At this time, the pseudo gray level data $y_r$ generated for Case 2 and Case 3 is short of the contrast. Therefore, the voltage determined correspondingly to the pseudo gray level data $y_r$ generated for Case 2 and Case 3 is desired to be in the following range.

Figure 18A:
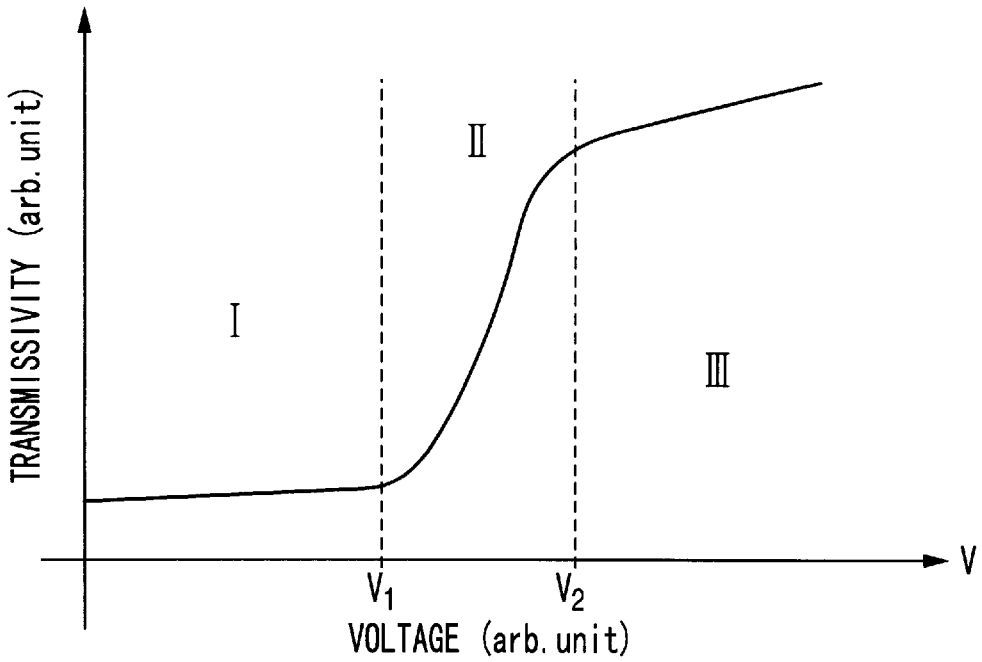
FIG. 18A shows a dependency of a transmissivity of pixels 8 on a voltage applied to the pixels 8.
Figure 18B:
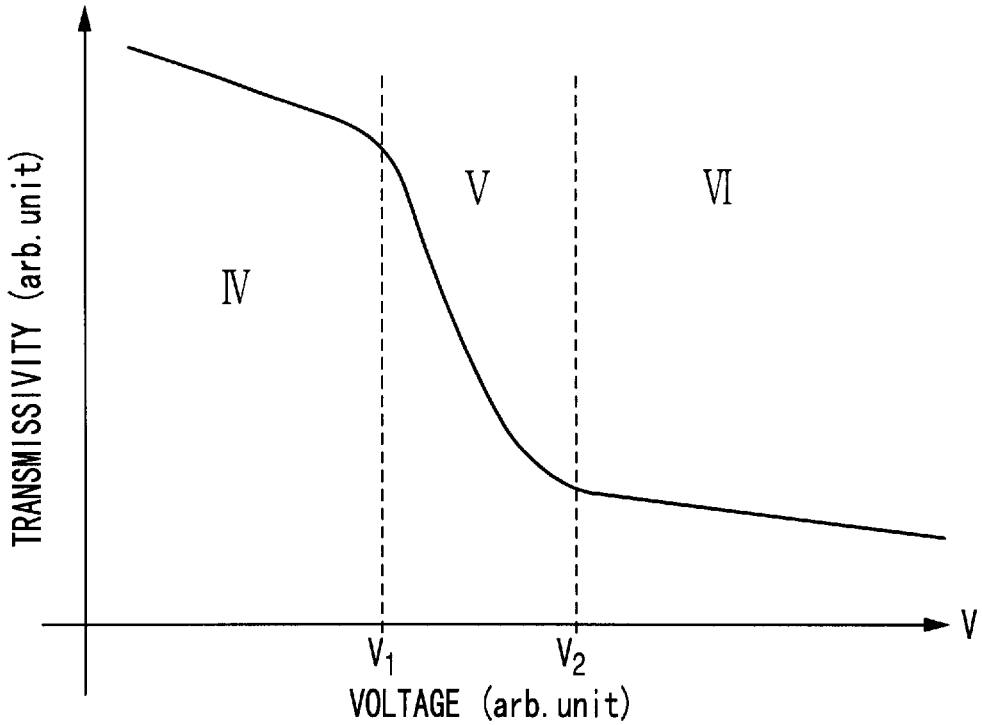
FIG. 18B shows a dependency of a transmissivity of pixels 8 on a voltage applied to the pixels 8.

FIGS. 18A and 18B are views showing a voltage applied to the pixels 8, and a transmissivity of liquid crystal constituting the pixels 8. FIG. 18A shows the transmissivity of the liquid crystal constituting the pixels 8 depending on the voltage applied to pixels 8 when the pixel 8 is composed of the liquid crystal having a lower transmissivity as the voltage is lower, namely, the pixels 8 are normally black.

The transmissivity of the liquid crystal constituting the pixel 8 exhibits the dependencies, which are different in three regions of a I region, a II region and a III region, depending on the voltages. In the I region in which the voltage applied to the pixel 8 is lower than a voltage $V_1$, as the voltage is higher, the transmission rate is gradually increased. In the II region in which the voltage applied to the pixel 8 is higher than the voltage $V_1$ and lower than a voltage $V_2$, as the voltage is higher, the transmissivity is increased more sharply than in the I region. In the III region in which the voltage applied to the pixels 8 is higher than the voltage $V_2$, a ratio of the increase in the transmission rate to the voltage applied to the pixel 8 is lower than that of the II region.

If the pixels 8 are composed of the liquid crystal exhibiting such property, the voltage determined correspondingly to the pseudo gray level data $y_r$ generated for Case 2 and Case 3 is desired to be the voltage in the I region or the III region. Such determination of the voltage improves the contrast of the LCD 1.

The similar discussion can be established when the pixels 8 are composed of the liquid crystal having the lower transmissivity as the voltage is higher, namely, when the pixel 8 is normally white. FIG. 18B shows a voltage applied to the pixels 8 and the transmissivity of the liquid crystal constituting the pixel 8 when the pixels 8 are normally white. For the pixels 8 being normally white, the voltage determined correspondingly to the pseudo gray level data $y_r$ generated for Case 2 and Case 3 is desired to be a voltage in a IV region or a VI region whose change rate of a transmission rate to a voltage is lower than that of a V region shown in FIG. 18B.

The above-mentioned method of defining the initial state variable data $x_r^{INI}$ has an influence on a generation of a fixed pattern shown on the LCD 1. The content of the initial value determiner ROM 35*a* that is referred to in generating the initial state variable data $x_r^{INI}$ shown in FIG. 6 is defined in accordance with an initializing method shown in FIG. 13, which reduces the generation of the fixed pattern. The initializing method will be described below with reference to FIG. 13.

Step S01

The number N of bits used for error diffusion calculation is given. The number m of the bits in the pseudo gray level is a difference the number n of bits in an input gray level data $u_r$ minus the number m of bits in a pseudo gray level data $y_r$. The number N is given by $$N=n-m.$$

A step S02 is carried out following the step S01.

Step S02

A basic initial value is defined which is an initial state variable data $x_r^{INI}$ (1, 1) for the first line $\mathbf{7}_1$ during the first frame. The basic initial value is defined such that the initial state variable data $x_{RA}^{INI}$ (1, 1) and $x_{RB}^{INI}$ (1, 1) are different, $x_{GA}^{INI}$ (1, 1) and $x_{GB}^{INI}$ (1, 1) are different, and $x_{BA}^{INI}$ (1, 1) and $x_{BB}^{INI}$ (1, 1) are different. In this embodiment, as shown in the line $\mathbf{41}_{1,1}$ of FIG. 6, they are defined as follows:

$$x_{RA}^{INI}(1, 1)=0,$$

$$x_{GA}^{INI}(1, 1)=2,$$

$$x_{BA}^{INI}(1, 1)=1,$$

$$x_{RB}^{INI}(1, 1)=3,$$

$$x_{GB}^{INI}(1, 1)=0, \text{ and}$$

$$x_{BB}^{INI}(1, 1)=2.$$

A step S03 is carried out following the step S02.

Step S03

One of line combination patterns shown in FIG. 14 is selected. In this embodiment, it is assumed that the combination pattern 1 is selected. A step S04 is carried out following the step S03.

Step S04

An initial state variable data $x_r^{INI}$ (j, 1) is defined for each lateral line 7, in accordance with the combination pattern 1 selected at the step S03.

The initial state variable data $x_r^{INI}$ (j, 1) have the same value for each four lateral lines 7. That is, initial state variable data $x_r^{INI}$ (j, 1) defined for a lateral line $\mathbf{7}_j$ with j being 4t+1 are same, where t is an integer of 0 or more. Similarly, initial state variable data $x_r^{INI}$ (j, 1) defined for a lateral line $\mathbf{7}_j$ with j being 4t+2, a lateral line $\mathbf{7}_j$ with j being 4t+3 and a lateral line $\mathbf{7}_j$ with j being 4t+4 are respectively same. This fact is represented such that the initial state variable data $x_r^{INI}$ (j, 1) has a four-line cycle.

The initial state variable data $x_r^{INI}$ (j, 1) shown in FIG. 6 are defined in accordance with the combination pattern 1, as given by a next equation group:

$$x_r^{INI}(4t+2, 1)=x_r^{INI}(4t+1, 1)+1,$$

$$x_r^{INI}(4t+3, 1)=x_r^{INI}(4t+2, 1)+1, \text{ and}$$

$$x_r^{INI}(4t+4, 1)=x_r^{INI}(4t+3, 1)+1$$

where t is a natural number of 0 or more. Thus, the initial state variable data $x_r^{INI}$ (4t+1, 1), $x_r^{INI}$ (4t+2, 1), $x_r^{INI}$ (4t+3, 1) and $x_r^{INI}$ (4t+4, 1) are defined as being values different from each other. A step S05 is carried out following the step S04.

Step S05

Figure 15:
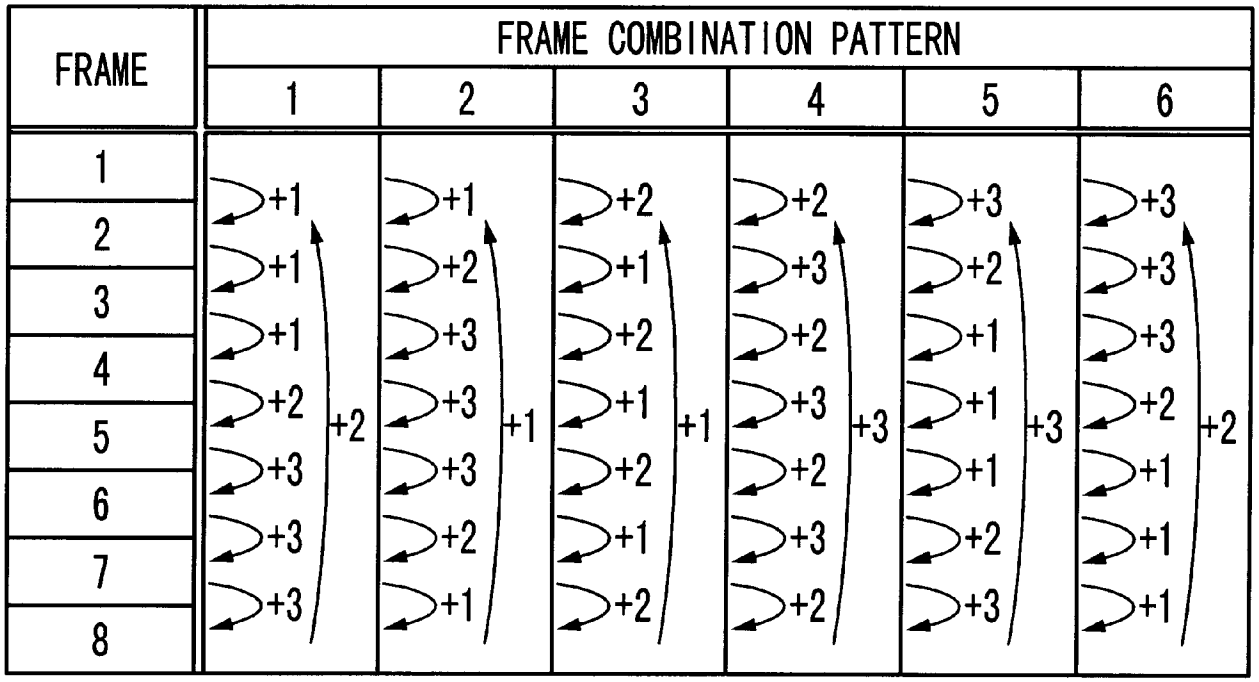
FIG. 15 shows a frame combination pattern.

One of frame combination patterns shown in FIG. 15 is selected. In this embodiment, it is assumed that a combination pattern 4 shown in FIG. 15 is selected. A step S06 is carried out following the step S05.

Step S06

An initial state variable data $x_r^{INI}$ (j, k) is defined for each frame, in accordance with the combination pattern 4 selected at the step S05.

The initial state variable data $x_r^{INI}$ (j, k) have the same value for each eight frames. That is, an initial state variable data $x_r^{INI}$ (j, k) are same which are defined for k-th frames of k=8s+1. Here, s is an integer of 0 or more. Similarly, initial state variable data $x_r^{INI}$ (j, k) are same which are respectively defined for a k-th frame of j=8s+2, a k-th frame of j=8s+3, a k-th frame of 8s+4, a k-th frame of k=8s+5, a k-th frame of k=8s+6, a k-th frame of k=8s+7 and a k-th frame of 8s+8. This fact is represented such that the initial state variable data $x_r^{INI}$ (j, k) has an eight-frame cycle.

The initial state variable data $x_r^{INI}$ (j, 1) shown in FIG. 6 are defined in accordance with the combination pattern 4, as given by a next equation group:

$$x_r^{INI}(j,\ 8s+2)=x_r^{INI}(j,\ 8s+1)+2,$$

$$x_r^{INI}(j,\ 8s+3)=x_r^{INI}(j,\ 8s+2)+3,$$

$$x_r^{INI}(j,\ 8s+4)=x_r^{INI}(j,\ 8s+3)+2,$$

$$x_r^{INI}(j,\ 8s+5)=x_r^{INI}(j,\ 8s+4)+3,$$

$$x_r^{INI}(j,\ 8s+6)=x_r^{INI}(j,\ 8s+5)+2,$$

$$x_r^{INI}(j,\ 8s+7)=x_r^{INI}(j,\ 8s+6)+3, \text{ and}$$

$$x_r^{INI}(j,\ 8s+8)=x_{INI}(j,\ 8s+7)+2.$$

Figure 13:
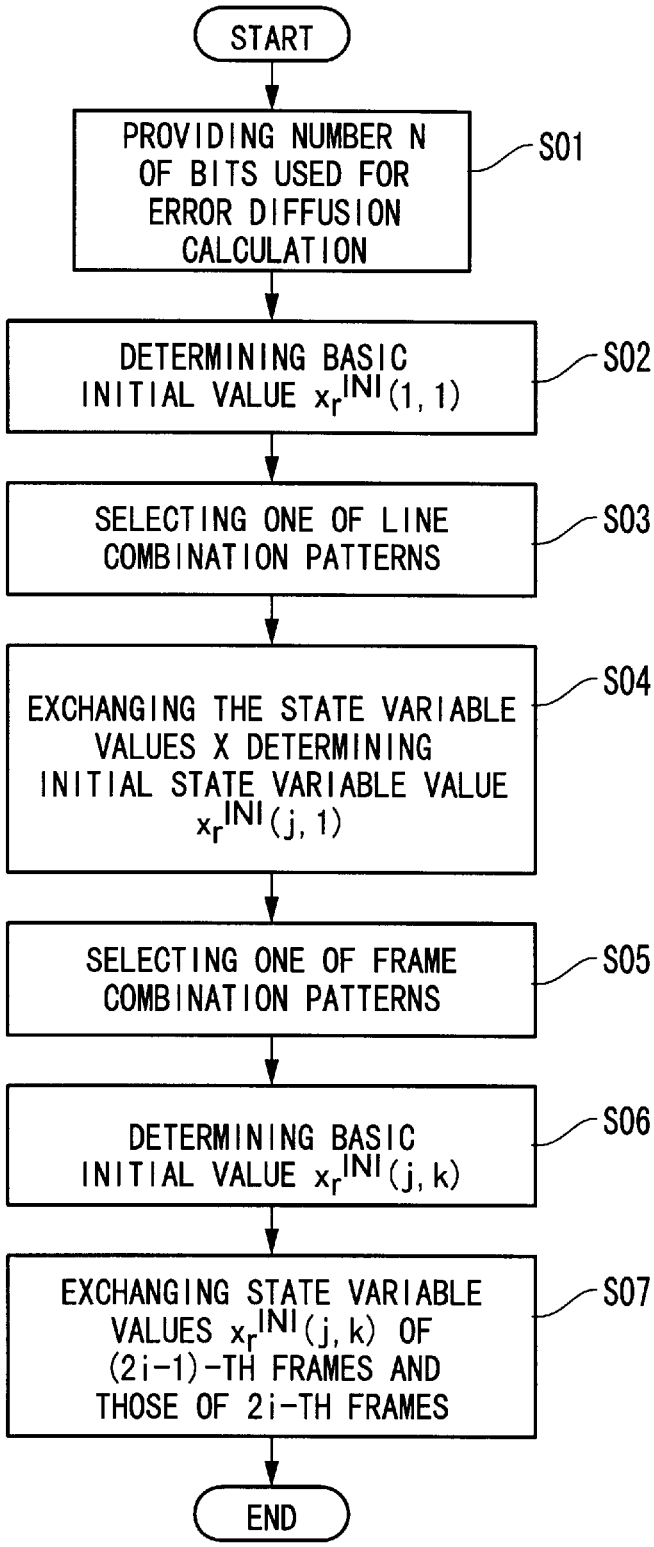
FIG. 13 shows a method of defining an initial state variable data $x_r^{INI}$.

A step S07 is carried out following the step S06, as shown in FIG. 13.

Step S07

The initial state variable data $x_r^{INI}$ (j, k) of odd-numbered frames and the initial state variable data $x_r^{INI}$ (j, k) of even-numbered frames are replaced in the former four frames and the latter four frames.

This results in the round of the initial state variable data $x_r^{INI}$ in the first to fourth frames. Moreover, the initial state variable data $x_r^{INI}$ are defined such that the respective initial state variable data $x_r^{INI}$ in the first frame and the sixth frames, the second frame and the fifth frame, the third frame and the eighth frame, and the fourth frame and the seventh frame are equal to each other. Accordingly, the fixed pattern is hard to be induced in the picture displayed by the LCD 1.

As mentioned above, the pseudo gray level processors 3 in the first embodiment allows the m-bit pseudo gray level data $y_r$ (i, j, k) to indicate the $2^n$ gray levels in the pseudo manner. Moreover, the generation of the initial state variable data $x_r^{INI}$ based on the above-mentioned method enables the fixed pattern to be hard to be induced in the picture displayed by the LCD 1.

In the first embodiment, the LCD 1 may be another display apparatus that is driven on the basis of a digitized input picture signal, for example, such as PDP.

Second Embodiment

A display apparatus according to a second embodiment has the configuration similar to that of the display apparatus of the first embodiment. In the display apparatus of the second embodiment, the method of generating the pseudo gray level data $y_r$ on the basis of the input gray level data $u_r$ is different from that of the display apparatus of the first embodiment. In the second embodiment, the above-mentioned value $v_r$ is calculated by subtracting the state variable data $x_r$ from the lower bit data $u_r^L$, which is the lower (n−m) bits of the input gray level data $u_r$. Moreover, in the second embodiment, the carry data $CRY_r$ is generated depending on whether or not the carry-over is induced when the state variable data $x_r$ is subtracted from the lower bit data $u_r^L$.

Figure 16:
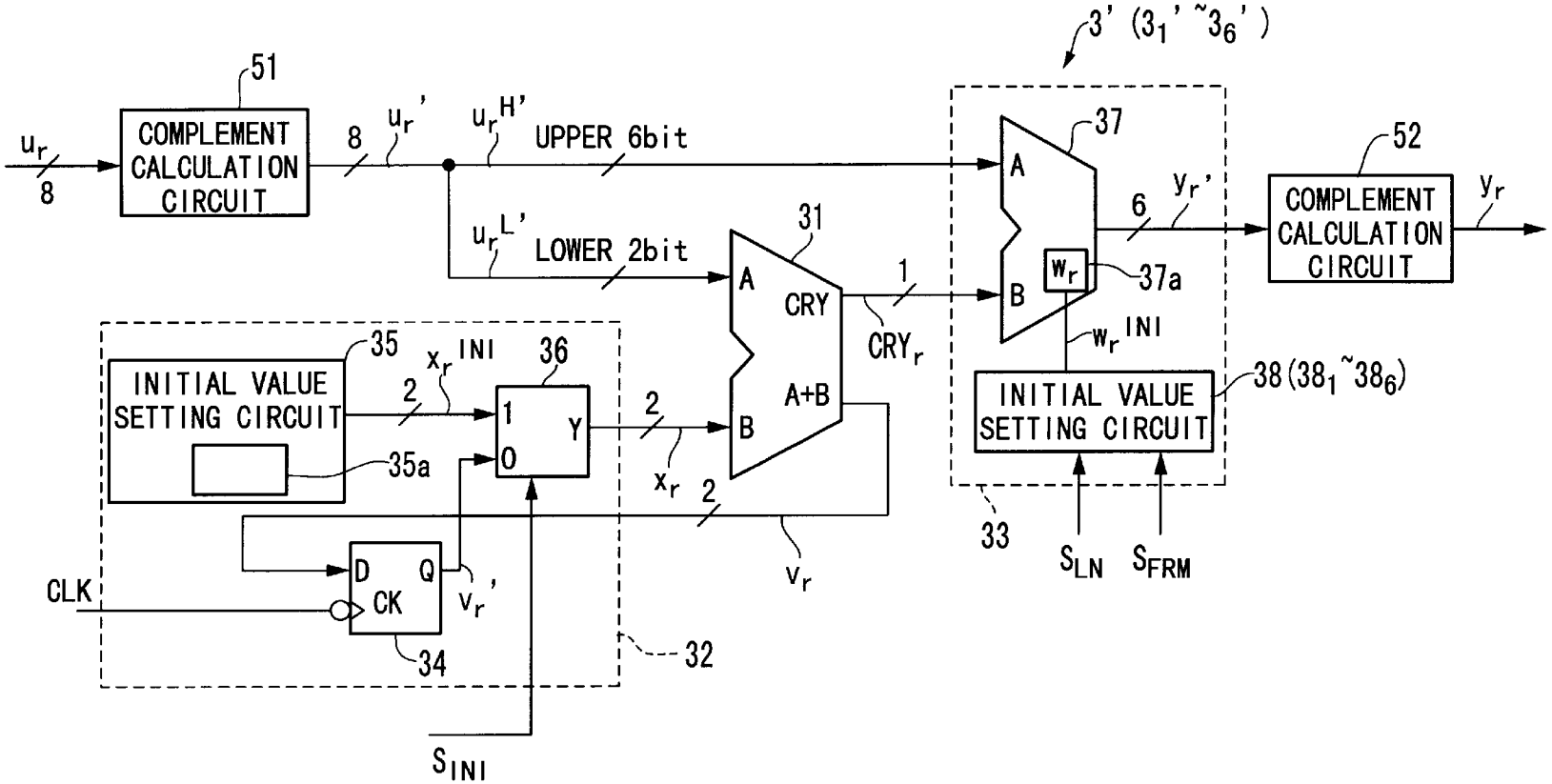
FIG. 16 shows pseudo gray level processors 3'.

In accordance with the operation, the pseudo gray level processors $\mathbf{3}_1$–$\mathbf{3}_6$ of the display apparatus in the first embodiment are replaced by pseudo gray level processors $\mathbf{3}_1'$–$\mathbf{3}_6'$ shown in FIG. 16. The pseudo gray level processors $\mathbf{3}_1'$–$\mathbf{3}_6'$ are referred to as a pseudo gray level processors 3'. The other units of the display apparatus in the second embodiment have the same configuration as the first embodiment and carries out the same operation as the first embodiment.

As shown in FIG. 16, the pseudo gray level processor 3' has the configuration similar to that of the pseudo gray level processor 3. The pseudo gray level processor 3' has the configuration in which complement calculation circuits 51, 52 are added to the pseudo gray level processor 3. The complement calculation circuit 51 calculates a complement input gray level data $u_r'$ implying a complement of the input gray level data $u_r$.

The adder 31 adds a complement lower bit data $u_r^{L'}$, which is lower order (n−m) bits of the complement input gray level data $u_r'$, and a state variable data $x_r$, and outputs a value $v_r$.

Moreover, if the sum of the complement lower bit data $u_r^{L'}$ and the state variable data $x_r$ results in the generation of the carry-over, the adder 31 sets a carry data $CRY_r$ to "1" output to the pseudo gray level calculator 33. If there is no generation of the carry-over, the adder 31 sets the carry data $CRY_r$ to "0" output to the pseudo gray level calculator 33.

The state variable data generator 32 generates the state variable data $x_r$ on the basis of the value $v_r$. The process when the state variable data generator 32 generates the state variable data $x_r$ is the same as the first embodiment. Detailed explanation of state variable data generator 32 is not given.

The pseudo gray level data calculator 33 generates a complement pseudo gray level data $y_r'$ on the basis of a complement upper bit data $u_r^{H'}$ and the carry data $CRY_r$. Here, the complement upper bit data $u_r^{H'}$ is upper m bits of the complement input gray level data $u_r'$. The complement pseudo gray level data $y_r'$ is a complement of a pseudo gray level data $y_r$ to be finally generated. In the second embodiment, the process for generating the complement pseudo gray level data $y_r'$ on the basis of the complement upper bit data $u_r^{H'}$ is the same as the process for generating the pseudo gray level data $y_r$ on the basis of the upper bit data $u_r^H$. Therefore, the detailed explanation is not done. The pseudo gray level data calculator 33 outputs the complement pseudo gray level data $y_r'$ to the complement calculation circuit 52. The complement calculation circuit 52 calculates a complement of the complement pseudo gray level data $y_r'$ and generates the pseudo gray level data $y_r$.

In the second embodiment, the pseudo gray level processor 3' performs the same calculation as the first embodiment, on the complement of the input gray level data $u_r$ to calculate the complement pseudo gray level data $y_r'$. Then, the pseudo gray level processor 3' calculates the complement of the complement pseudo gray level data $y_r'$ and generates the pseudo gray level data $y_r$.

The above mentioned operation corresponds to the operation in which all the additions done in the first embodiment are replaced by the subtractions. That is, in the second embodiment, the value $v_r$ is generated by subtracting the state variable data $x_r$ from the lower bit data $u_r^L$. The carry data $CRY_r$ is set to "1" if the carry-over is induced at a time of the subtraction, and the carry data $CRY_r$ is set to "0" if the carry-over is not induced. Moreover, the calculation for adding the upper bit data $u_r^H$ and the carry data $CRY_r$, which is done in the gray level corresponding to Case 1 of the first embodiment is replaced by the calculation for subtracting the carry data $CRY_r$ from the upper bit data $u_r^H$.

FIG. 17 shows the correspondence between the input gray level data $u_r$ and the pseudo gray level data $y_r$ in the second embodiment. The process for generating the pseudo gray level data $y_r$ is classified into the following four cases.

Case 1

Case 1 is the case when at least one of the upper (m−1) bits of the input gray level data $u_r$ (i, j, k) is at "1".

Case 1 implies the case when $u_r$ (i, j, k) given by the decimal notation is given by:

$$2^{(n-m+1)} \leqq u_r(i, j, k) \leqq 2^n - 1$$

In this embodiment of n=8 and m=6, Case 1 is the case when $$8 \leqq u_r(i, j, k) \leqq 255$$

In Case 1, the pseudo gray level data $y_r$ (i, j, k) is defined by $$y_r(i, j, k) = u_r^{H1}(i, j, k) - CRY_r(i, j, k)$$

where $u_r^{H1}$ (i, j, k) is upper m bit of the input gray level data $u_r$ (i, j, k).

Case 2

Case 2 is the case when all of the upper (m−1) bits of the input gray level data $u_r$ (i, j, k) are at "0" and an m-th significant bit of the input gray level data $u_r$ (i, j, k) is at "1". In the embodiment of n=8 and m=6, Case 2 implies the case when $$u_r^{H1}(i, j, k) = \text{"000001"},$$

where $u_r^{H1}$ (i, j, k) is the upper m bit of the input gray level data $u_r$ (i, j, k).

When the input gray level data $u_r$ (i, j, k) is given by the decimal notation, Case 2 is the case when $$2^{(n-m)} \leqq u_r(i, j, k) \leqq 2^{(n-m+1)} - 1.$$

In this embodiment of n=8 and m=6, Case 2 is the case when $$4 \leqq u_r(i, j, k) \leqq 7.$$

Case 2 is further classified into the following two cases, depending on the carry data $CRY_r$ (i, j, k).

Case 2-1

Case 2-1 is the case when the carry data $CRY_r$ (i, j, k) is "0". In this case, the pseudo gray level data $y_r$ (i, j, k) is defined by $$y_r(i, j, k) = u_r^{H1}(i, j, k).$$

where $u_r^{H1}$ (i, j, k) is the upper m bits of the input gray level data $u_r$ (i, j, k), as mentioned above. In this embodiment, the pseudo gray level data $y_r$ (i, j, k) is given by $$y_r(i, j, k) = \text{"000001"}.$$

Case 2-2

Case 2-2 is the case when the carry data $CRY_r$ (i, j, k) is "1". In Case 2-2, the upper bit data $y_r^H$ (i, j, k), which is the upper (m−1) bits of the pseudo gray level data $y_r$ (i, j, k), is given by $$y_r^H(i, j, k) = u_r^{H2}(i, j, k)$$

where $u_r^{H2}$ (i, j, k) is the upper (m−1) bits of the input gray level data $u_r$ (i, j, k). In this embodiment, the upper bit data $y_r^H$ (i, j, k) is given by $$y_r^H(i, j, k) = \text{"00000"}.$$

Moreover, the least significant bit data $y_r^{LSB}$ (i, j, k), which is the LSB of the pseudo gray level data $y_r$ (i, j, k), is given by $$y_r^{LSB}(i, j, k) = W_r.$$

As mentioned above, the value $W_r$ is stored in the counter 37*a*. The value $W_r$ is toggled each time the LSB $y_r^{LSB}$ (i, j, k) is generated on the basis of the value $W_r$. Thus, the least significant bit data $y_r^{LSB}$ (i, j, k) becomes at "0" at the rate of once every two times, and becomes at "1" at the rate of once every two times.

When all the bits of the lower bit data $u_r^L$ (i, j, k), which is the lower (n−m) bits of the input gray level data $u_r$ (i, j, k), are "1", the carry-over is never induced by the subtraction of the state variable data $x_r$ (i, j, k) from the lower bit data $u_r^L$ (i, j, k). In this embodiment of n=8 and m=6, such the case corresponds to the case when $$u_r(i, j, k) = \text{"00000111"}.$$

In FIG. 17, the fact that the carry-over is never induced is indicated by the symbol "–".

Case 3

Case 3 is the case when all of the upper m bits of the input gray level data $u_r$ (i, j, k) are at "0" and at least one of the low order (n−m) bits of the input gray level data $u_r$ (i, j, k) is at "1". In this embodiment of n=8 and m=6, Case 3 implies the case when $$u_r(i, j, k) = \text{"000000"}, \text{ and}$$

$$u_r(i, j, k) \neq \text{"00000000"}.$$

When the input gray level data $u_r$ (i, j, k) is given by the decimal notation, Case 3 is the case when $$1 \leqq u_r(i, j, k) \leqq 2^{(n-m)} - 1.$$

In this embodiment of n=8 and m=6, this means $$1 \leqq u_r(i, j, k) \leqq 3.$$

Case 3 is further classified into the following two cases, depending on the carry data $CRY_r$ (i, j, k).

Case 3-1

Case 3 is the case when the carry data $CRY_r$ (i, j, k) is "0". In Case 3, the upper bit data $y_r^H$ (i, j, k), which is the upper (m−1) bits of the pseudo gray level data $y_r$ (i, j, k), is given by $$y_r^H(i, j, k) = u_r^{H2}(i, j, k),$$

where $u_r^{H2}$ (i, j, k) is the upper (m−1) bits of the input gray level data $u_r$ (i, j, k). In this embodiment, the upper bit data $y_r^H$ is given by $$y_r^H(i, j, k) = \text{"00000"}.$$

Moreover, the least significant bit data $y_r^{LSB}$ (i, j, k) that is the least significant bit of the pseudo gray level data $y_r$ (i, j, k) is given by:

$$y_r^{LSB}(i, j, k) = W_r$$

As mentioned above, the value $W_r$ is the value stored in the counter 37*a*. The value $W_r$ is toggled each time the LSB $y_r^{LSB}$ (i, j, k) is generated on the basis of the value $W_r$. Thus, the LSB $y_r^{LSB}$ (i, j, k) becomes at "0" at the rate of once every two times, and becomes at "1" at the rate of once every two times.

Case 3-2

Case 3 is the case when the carry data $CRY_r$ (i, j, k) is "1". In Case 3, the pseudo gray level data $y_r$ (i, j, k) is defined by $$y_r(i, j, k)=u_r(i, j, k),$$

where $u_r^{H1}$ (i, j, k) is the upper m bits of the input gray level data $u_r$ (i, j, k), as mentioned above. In this embodiment, the pseudo gray level data $y_r$ is given by $$y_r(i, j, k)=\text{"000000"}.$$

When all the bits of the lower bit data $u_r^L$ (i, j, k) are at "1", the carry-over is never induced by the subtraction of the state variable data $x_r$ (i, j, k) from the lower bit data $u_r^L$ (i, j, k). In this embodiment of n=8 and m=6, this corresponds to the case when $$u_r(i, j, k)=\text{"00000011"}.$$

In FIG. 17, the fact that the carry-over is never induced in the case when $u_r$ (i, j, k)="00000011" is indicated by the symbol "–".

Case 4

Case 4 is the case when all of the bits of the input gray level data $u_r$ (i, j, k) are at "0". In the embodiment of n=8 and m=6, Case 4 implies the case when $$u_r(i, j, k)=\text{"00000000"}.$$

When the input gray level data $u_r$ (i, j, k) is given by the decimal notation, Case 4 is the case when $$u_r(i, j, k)=0.$$

In Case 4, irrespectively of the carry data $CRY_r$ (i, j, k), the pseudo gray level data $y_r$ is defined by $$y_r(i, j, k)=u_r^{H1}(i, j, k).$$

The $u_r^{H1}$ (i, j, k) is the upper m bits of the input gray level data $u_r$ (i, j, k). That is, in this embodiment, the pseudo gray level data $y_r$ is given by $$y_r(i, j, k)=\text{"000000"}.$$

The m-bit pseudo gray level data $y_r$ (i, j, k) generated by the above-mentioned processes can indicate the $2^n$ gray levels in the pseudo way.

In the second embodiment, also, the LCD 1 may be another display apparatus that is driven on the basis of the digitized input picture signal such as a PDP.

Third Embodiment

A display apparatus according to a third embodiment has the configuration similar to that of the display apparatus of the first embodiment. In the display apparatus of the third embodiment, the method of generating the pseudo gray level data $y_r$ is different from that of the display apparatus of the first embodiment. In the third embodiment, the pseudo gray level processors $\mathbf{3}_1$–$\mathbf{3}_6$ of the display apparatus in the first embodiment are replaced by pseudo gray level processors $\mathbf{13}_1$–$\mathbf{13}_6$ shown in FIG. 19. The pseudo gray level processors $\mathbf{13}_1$–$\mathbf{13}_6$ may be referred to as pseudo gray level processors 13.

The pseudo gray level processors 13 have the configuration similar to that of the pseudo gray level processors 3 in the first embodiment. The pseudo gray level processors 13 have the configuration in which the pseudo gray level data calculator 33 of the pseudo gray level processor 3 is replaced by a pseudo gray level data calculator 43. The pseudo gray level data calculator 33 and the pseudo gray level data calculator 43 carry out the operations different from each other, in the following points.

As mentioned above, the pseudo gray level data calculator 33 in the first embodiment sets the pseudo gray level data $y_r^{LSB}$ to the value equal to the value $W_{RA}$ stored in the counter 37*a* when the input gray level data $u_r$ corresponding to Case 2-2 or 3-1 is inputted.

On the other hand, the pseudo gray level data calculator 43 in the third embodiment defines the pseudo gray level data $y_r^{LSB}$ on the basis of a position of a pixel 8 whose gray level is specified by the input gray level data $u_r$, when the input gray level data $u_r$ corresponding to the case 2-2 or 3-1 is inputted. The pseudo gray level data calculator 43 defines the pseudo gray level data $y_r^{LSB}$ independently of each other for respective frames. That is, when the input gray level data $u_r$ (i, j, k) corresponding to the case 2-2 or 3-1 is inputted, the pseudo gray level data calculator 43 defines the pseudo gray level data $y_r^{LSB}$ on the basis of the affixes j, k.

The other configurations and operations of the display apparatus in the third embodiment are equal to those of the display apparatus in the first embodiment. The configuration and the operation of the pseudo gray level processors 13 in the third embodiment will be described in detail.

Figure 19:
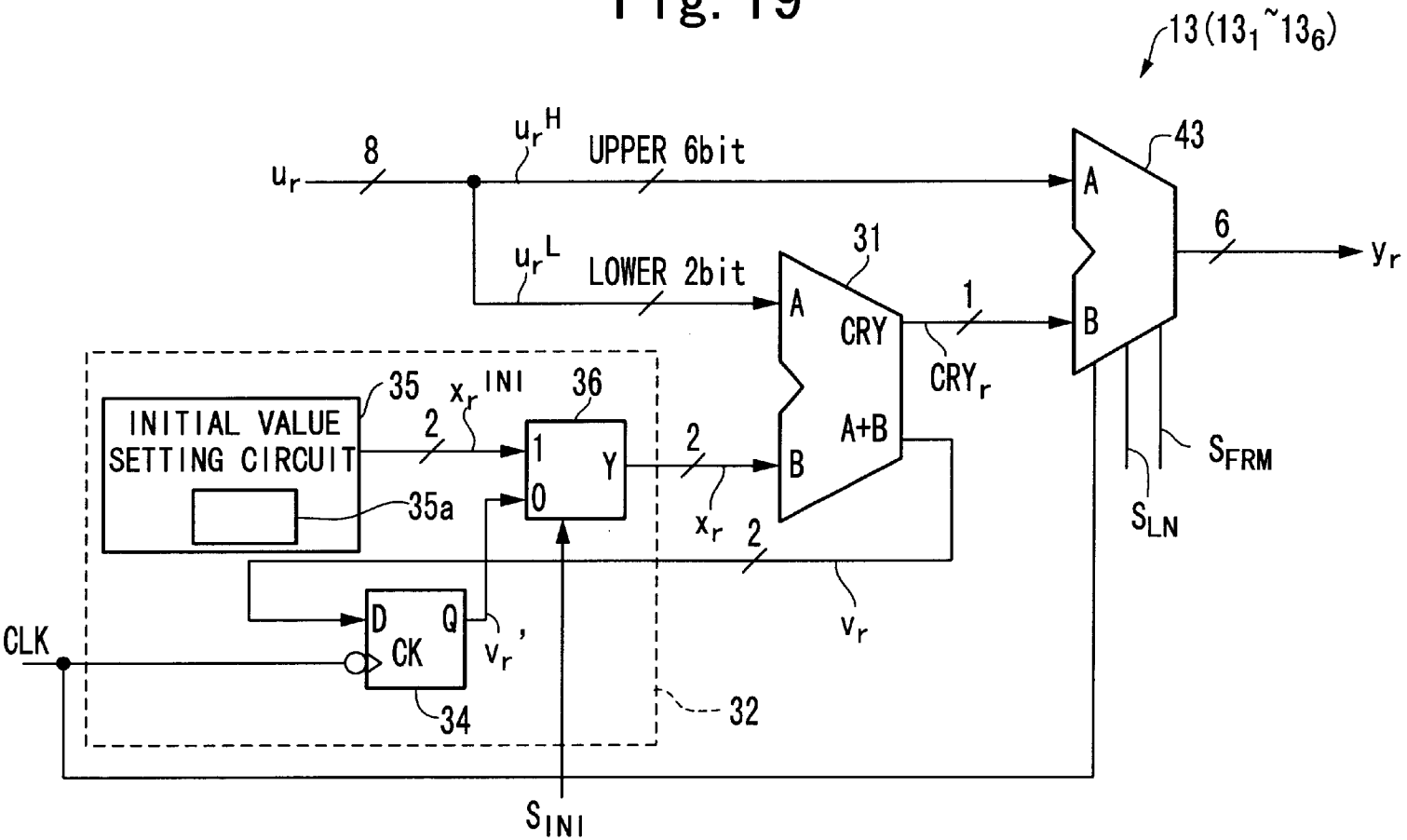
FIG. 19 shows a pseudo gray level processor 13 in a third embodiment.

As shown in FIG. 19, the pseudo gray level processor 13 includes an adder 31, a state variable data generator 32. The adder 31 adds a lower bit data $u_r^L$ and a state variable data $x_r$ generated by the state variable data generator 32 to output the value $v_r$ of (n–m) bits, where the lower bit data $u_r^L$ is lower (n–m) bits of the input gray level data $u_r$.

Moreover, if the sum of the lower bit data $u_r^L$ and the state variable data $x_r$ results in the generation of the carry-over, the adder 31 sets a carry data $CRY_r$ to "1" to output the pseudo gray level data calculator 43. If there is no generation of the carry-over, the adder 31 sets the carry data $CRY_r$ to "0" to output to the pseudo gray level data calculator 43.

The state variable data generator 32 generates the state variable data $x_r$ on the basis of the value $v_r$. An initial state variable data $x_r^{INI}$ of the state variable data $x_r$ is defined with reference with the initial value determiner ROM 35*a* having the content of the table shown in FIG. 6, similarly to the first embodiment. The process when the state variable data generator 32 generates the state variable data $x_r$ is the same as the first embodiment.

The pseudo gray level data calculator 43 generates the pseudo gray level data $y_r$, on the basis of the upper bit data $u_r^H$, the carry data $CRY_r$, the clock signal CLK, the line management signal $S_{LN}$ and the frame management signal $S_{FRM}$, as shown in FIG. 19. The line management signal $S_{LN}$ indicates which of lateral lines 7 are enabled to activate the pixels 8. That is, the pseudo gray level data calculator 43 recognizes the affix j, on the basis of the line management signal $S_{LN}$. The frame management signal $S_{FRM}$ indicates a frame of the inputted input gray level data $u_r$. That is, the pseudo gray level data calculator 43 recognizes the affix k on the basis of the frame management signal $S_{FRM}$.

FIG. 20 is a truth table of the pseudo gray level data $y_r$ (i, j, k) outputted by the pseudo gray level data calculator 43. The calculation carried out by the pseudo gray level data calculator 43 is classified into the following four cases.

Case 1

Case 1 is the case when at least one of the upper (m–1) bits of the input gray level data $u_r$ (i, j, k) is at "0".

Case 1 implies the case when $u_r$ (i, j, k) in the decimal notation is given by $$0 \leqq u_r(i, j, k) \leqq 2^n - 2^{(n-m+1)} - 1.$$

In this embodiment of n=8 and m=6, Case 1 is the case when $$0 \leqq u_r(i, j, k) \leqq 247.$$

In Case 1, the pseudo gray level data $y_r$ (i, j, k) is defined by $$y_r(i, j, k) = u_r^{H1}(i, j, k) + CRY_r(i, j, k)$$

where $u_r^{H1}$ (i, j, k) is upper m bit of the input gray level data $u_r$ (i, j, k).

Case 2

Case 2 is the case when all of the upper bits of the input gray level data $u_r$ (i, j, k) are at "1" and an m-th significant bit of the input gray level data $u_r$ (i, j, k) is at "0". In the embodiment of n=8 and m=6, Case 2 implies the case when $$u_r^{H1}(i, j, k) = \text{"111110"},$$

When the input gray level data $u_r$ (i, j, k) is given by the decimal notation, Case 2 is the case when $$2^n - 2^{(n-m+1)} \leqq u_r(i, j, k) \leqq 2^n - 2^{(n-m)} - 1,$$

In this embodiment of n=8 and m=6, Case 2 is the case when $$248 \leqq u_r(i, j, k) \leqq 251.$$

Case 2 is further classified into the following two cases, depending on the carry data $CRY_r$ (i, j, k).

Case 2-1

Case 2-1 is the case when the carry data $CRY_r$ (i, j, k) is "0". In Case 2-1, the pseudo gray level data $y_r$ (i, j, k) is defined by $$y_r(i, j, k) = u_r^{H1}(i, j, k).$$

In this embodiment, the pseudo gray level data $y_r$ is given by $$y_r(i, j, k) = \text{"111110"}.$$

Case 2-2

Case 2-2 is the case when the carry data $CRY_r$ (i, j, k) is "1". In Case 2-2, the upper bit data $y_r^H$ (i, j, k), which is the upper (m−1) bits of the pseudo gray level data $y_r$ (i, j, k) is given by $$y_r^H(i, j, k) = u_r^{H2}(i, j, k),$$

where $u_r^{H2}$ (i, j, k) is the upper (m−1) bits of the input gray level data $u_r$ (i, j, k).

The LSB $y_r^{LSB}$ (i, j, k) of pseudo gray level data $y_r$ (i, j, k) is obtained by $$y_r^{LSB}(i, j, k) = z_r(i, j).$$

where $z_r$ is defined as shown in FIGS. 21A, 21B.

With reference to FIG. 21A, when k is any of 8s+1, 8s+2, 8s+3 and 8s+4, and r is any of "RA", "GA" and "BA" (s is an integer of 0 or more), the value $z_r$ (i, k) is obtained by $$z_r(j, k) = \text{"0"},$$

for j being 8t+1, 8t+2, 8t+3 and 8t+4, where t is an integer of 0 or more.

In this case, the value $z_r$ (i, k) is obtained for j being 8t+5, 8t+6, 8t+7 and 8t+8 by $$z_r(j, k) = \text{"1"}.$$

When k is any of 8s+1, 8s+2, 8s+3 and 8s+4, and r is any of "RB", "GB" and "BB", the value $z_r$ (j, k) is obtained by $$z_r(j, k) = \text{"1"},$$

for j being 8t+1, 8t+2, 8t+3 and 8t+4.

In this case, the value $z_r$ (j, k) is obtained for j being 8t+5, 8t+6, 8t+7 and 8t+8 by $$z_r(j, k) = \text{"0"}.$$

With reference to FIG. 21B, when k is any of 8s+5, 8s+6, 8s+7 and 8s+8, and r is any of "RA", "GA" and "BA", the value $z_r$ (j, k) is obtained by $$z_r(j, k) = \text{"1"},$$

for j being 8t+1, 8t+2, 8t+3 and 8t+4, where t is an integer of 0 or more.

In this case, the value $z_r$ (j, k) is obtained for j being 8t+5, 8t+6, 8t+7 and 8t+8 by $$z_r(j, k) = \text{"0"}.$$

When k is any of 8s+5, 8s+6, 8s+7 and 8s+8, and r is any of "RB", "GB" and "BB", the value $z_r$ (j, k) is obtained by $$z_r(j, k) = \text{"0"}.$$

for j being 8t+1, 8t+2, 8t+3 and 8t+4, where t is an integer of 0 or more.

In this case, the value $z_r$ (j, k) is obtained for j being 8t+5, 8t+6, 8t+7 and 8t+8 by $$z_r(j, k) = \text{"1"}.$$

The value $z_r$ (j, k) is different depending on whether r="RA", "GA" and "BA" or r="RB", "GB" and "BB". This implies that $z_r$ (j, k) is defined on the basis of a position of a pixel 8 in which a gray level is specified. At the time of r="RA", "GA" and "BA", the pseudo gray level data $y_r$ (i, j, k) specifies a gray level of a pixel $\mathbf{8}_{2i-1,\,j}$ connected to an odd-numbered longitudinal line $\mathbf{6}_{2i-1}$. On the other hand, at the time of r="RB", "GB" and "BB", the pseudo gray level data $y_r$ (i, j, k) specifies a gray level of a pixel $\mathbf{8}_{2i,\,j}$ connected to an odd-numbered longitudinal line $\mathbf{6}_{2i-1}$. In this way, the fact that $z_r$ (j, k) is defined depending on whether r="RA", "GA" and "BA" or r="RB", "GB" and "BB" implies that the $z_r$ (j, k) is defined depending on the specification of the gray level of the pixel $\mathbf{8}_{2i-1}$ connected to the odd-numbered longitudinal line $\mathbf{6}_{2i-1}$ or the specification of the gray level of the pixel $\mathbf{8}_{2i-1}$ connected to the even-numbered longitudinal line $\mathbf{6}_{2i-1}$. In this embodiment, $z_r$ (j, k) does not depend on the affix i. The value $z_r$ can be defined such that it depends on the affix i.

The value $z_r$ (j, k) alternately has the values of "1" and "0" at a spatial period of four lateral lines 7. This corresponds to the fact that the initial state variable data $x_r^{INI}$ generated by the above-mentioned initial value setting circuit 35 is designed so as to have the spatial period of the four lateral lines 7. The coincidence between the spatial period of $z_r$ (j. k) and the initial state variable data $x_r^{INI}$ allows the fixed pattern to be hard to be induced in the display of the LCD 1.

Moreover, $z_r$ (j, k) is designed such that a number of pixels 8 in which the pseudo gray level data $y_r$ are defined as being $z_r$ (j, k)="1" and a number of pixels 8 in which the pseudo gray level data $y_r$ are defined as being $z_r$ (j, k)="1". Also, $z_r$ (j, k) is designed such that a region of the pixels 8 in which the pseudo gray level data $y_r$ are defined as $z_r$ (j, k) being "1" and a region of the pixels 8 in which the pseudo gray level data $y_r$ are defined as $z_r$ (j, k) being "0" alternately appear in a direction of an extension of the lateral line 7. Similarly, $z_r$ (j, k) is designed such that the region of the pixels 8 in which the pseudo gray level data $y_r$ are defined as $z_r$ (j, k) being "1" and the region of the pixels 8 in which the pseudo gray level data $y_r$ are defined as $z_r$ (j, k)=being "0" alternately appear in a direction of an extension of the longitudinal line 6. This configuration reduced the color irregularity in the display of the LCD 1.

When all the bits of the lower bit data $u_r^L$ (i, j, k), which are the lower (n−m) bits of the input gray level data $u_r$ (i, j, k), are at "0", the carry-over is never induced by the addition of the lower bit data $u_r^L$ (i, j, k) and the state variable data $x_r$ (i, j, k). In this embodiment of n=8 and m=6, this corresponds to the case when $$u_r(i, j, k)=\text{"11111000"}.$$

In FIG. 20, the fact that the carry-over is never induced is indicated by the symbol "–".

Case 3

Case 3 is the case when all of the upper m bits of the input gray level data $u_r$ (i, j, k) are at "1" and at least one of the lower (n−m) bits of the input gray level data $u_r$ (i, j, k) is at "0". In the embodiment of n=8 and m=6, Case 3 implies the case when $$u_r^{H1}(i, j, k)=\text{"111111"}, \text{ and}$$

$$u_r(i, j, k)\neq\text{"11111111"}.$$

When the input gray level data $u_r$ (i, j, k) is given by the decimal notation, Case 3 is the case when $$2^n-2^{(n-m)}\leqq u_r(i, j, k)\leqq 2^n-2.$$

In this embodiment of n=8 and m=6, Case 3 is the case when $$252\leqq u_r(i, j, k)\leqq 254.$$

Case 3 is further classified into the following two cases, depending on the carry data $CRY_r$ (i, j, k).

Case 3-1

Case 3-1 is the case when the carry data $CRY_r$ (i, j, k) is "0". In Case 3-1, the upper bit data $y_r^H$ (i, j, k), which is the upper (m−1) bits of the pseudo gray level data $y_r$ (i, j, k), is given by $$y_r^H(i, j, k)=u_r^{H2}(i, j, k),$$

where $u_r^{H2}$ (i, j, k) is the upper (m−1) bits of the input gray level data $u_r$ (i, j, k).

Moreover, the LSB of the pseudo gray level data $y_r$ (i, j, k) is given by $$y_r^{LSB}(i, j, k)=z_r(j, k).$$

where, $z_r$ is the value defined as shown in the table of FIGS. 21A, 21B.

Case 3-2

Case 3-2 is the case when the carry data $CRY_r$ (i, j, k) is "1". In Case 3-2, the pseudo gray level data $y_r$ (i, j, k) is defined by $$y_r(i, j, k)=u_r^{H1}(i, j, k),$$

where $u_r^{H1}$ (i, j, k) is the upper m bits of the input gray level data $u_r$ (i, j, k). In this embodiment, the pseudo gray level data $y_r$ is given by $$y_r(i, j, k)=\text{"111111"}.$$

When all the bits of the lower bit data $u_r^L$ (i, j, k) are at "0", the carry-over is never induced by the addition of the lower bit data $u_r^L$ (i, j, k) and the state variable data $x_r$ (i, j, k). In this embodiment of n=8 and m=6, this corresponds the case when $$u_r(i, j, k)=\text{"11111100"}.$$

In FIG. 20, the fact that the carry-over is never induced in the case when $u_r$ (i, j, k)="11111100" is indicated by the symbol "–".

Case 4

Case 4 is the case when all of the bits of the input gray level data $u_r$ (i, j, k) are at "1". In the embodiment of n=8 and m=6, Case 4 implies the case when $$u_r(i, j, k)=\text{"11111111"}.$$

When the input gray level data $u_r$ (i, j, k) is given by the decimal notation, Case 4 is the case when $$u_r(i, j, k)=2^n-1.$$

In Case 4, irrespectively of the carry data $CRY_r$ (i, j, k), the pseudo gray level data $y_r$ is defined by $$y_r(i, j, k)=u_r^{H1}(i, j, k).$$

where $u_r^{H1}$ (i, j, k) is the upper m bits of the input gray level data $u_r$ (i, j, k). That is, in this embodiment, the pseudo gray level data $y_r$ is given by $$y_r(i, j, k)=\text{"111111"}.$$

The m-bit pseudo gray level data $y_r$ (i, j, k) generated as mentioned above can indicate the $2^n$ gray levels in the pseudo way.

The process for generating the pseudo gray level data $y_r$ (i, j, k) will be described below with regard to the input gray level data $u_r$ (i, j, k) defined as being an actual value.

Operation Example 3

In Operational Example 3, a process for generating the pseudo gray level data $y_r$ during the first frame (k=1) is described when the input gray level data $u_r$ is given by $$u_r(i, j, 1)=\text{"11111001"}.$$

namely, $$u_r(i, j, 1)=249.$$

As shown in FIG. 20, this is the case corresponding to Case 2. In this case, irrespectively of the carry data $CRY_r$, the upper bit data $y_r^H$, which is the upper (m−1) bits of the pseudo gray level data $y_r$, is given by $$y_r^H(i, j, 1)=\text{"11111"}.$$

The LSB $y_r^{LSB}$ (i, j, 1) of the pseudo gray level data $y_r$ (i, j, 1) is defined as follows. FIG. 22 shows the carry data $CRY_r$ (i, j, 1) and the LSB $y_r^{LSB}$ (i, j, 1) when the input gray level data $u_r$ is given by $$u_r(i, j, 1)=\text{"11111001"},$$

namely, $$u_r(i, j, 1)=249.$$

In FIG. 22, similarly to FIGS. 10 and 12, the values "0" and "1" indicate that the carry data $CRY_r$ (i, j, 1) are at "0" and "1", respectively. Moreover, the fact that the values "0" and "1" are hatched in FIG. 22 implies that the least significant bit $y_r^{LSB}$ (i, j, 1) is at "1". Also, the fact that they are not hatched in FIG. 22 implies that the LSB $y_r^{LSB}$ (i, j, 1) is at "0".

The case when the carry data $CRY_r$ (i, j, 1) is "0" corresponds to Case 2-1. In this case, the LSB $y_r^{LSB}$ (i, j, 1) of the pseudo gray level data $y_r$ is at "0".

On the other hand, the case when the carry data $CRY_r$ (i, j, 1) is "1" corresponds to Case 2-2. In this case, the LSB $y_r^{LSB}$ (i, j, 1) is $z_r$ (j, 1). Since k=1 in the first frame, $z_r$ (j, 1) is defined in accordance with the table of FIG. 21A.

With reference to FIG. 21A, when r="RA", "GA" and "BA" and j=1, 2, 3 and 4, the value $z_r$ (j, 1) is given by $$z_r(j, 1)=\text{"0"}.$$

Thus, when r="RA", "GA" and "BA" and j=1, 2, 3 and 4, the LSB $y_r^{LSB}$ (i, j, 1) is at "0" even if the carry data $CRY_r$ (i, j, 1)="1".

For example, in a case of i=1, the carry data $CRY_{RA}$, $CRY_{GA}$, $CRY_{BA}$, the LSB $y_{RA}^{LSB}$, $y_{GA}^{LSB}$, and $y_{BA}^{LSB}$ are given by:

$$CRY_{RA}(1, 4, 1)=\text{"1"}, y_{BA}^{LSB}(1, 4, 1)=\text{"0"}$$

$$CRY_{GA}(1, 2, 1)=\text{"1"}, y_{GA}^{LSB}(1, 2, 1)=\text{"0"}$$

$$CRY_{BA}(1, 3, 1)=\text{"1"}, y_{BA}^{LSB}(1, 3, 1)=\text{"0"}$$

On the other hand, when r="RB", "GB" and "BB" and j=1, 2, 3 and 4, with reference to FIG. 21A, the value $z_r$ (j, 1) is given by $$z_r(j, 1)=\text{"1"}$$

Thus, when r="RB", "GB" and "BB" and j=1, 2, 3 and 4 and the carry data $CRY_r$ (i, j, 1) is "1", the LSB $y_r^{LSB}$ (i, j , 1) is at 1.

For example, in the case of i=1, the carry data $CRY_{RB}$, $CRY_{GB}$, $CRY_{BB}$, the LSB $y_{RB}^{LSB}$, $y_{GB}^{LSB}$, and $y_{BB}^{LSB}$ are given by:

$$CRY_{RB}(1, 1, 1)=\text{"1"}, y_{RB}^{LSB}(1, 1, 1)=\text{"1"}$$

$$CRY_{GB}(1, 4, 1)=\text{"1"}, y_{GB}^{LSB}(1, 4, 1)=\text{"1"}$$

$$CRY_{BB}(1, 2, 1)=\text{"1"}, y_{BB}^{LSB}(1, 2, 1)=\text{"1"}$$

With regard to another r, i, j and k, the LSB $y_r^{LSB}$ (i, j, k) are calculated in the same way.

Operation Example 4

In an operational example 4, a process for generating the pseudo gray level data $y_r$ during the first frame (k=1) is described when the input gray level data $u_r$ is given by $$u_r(i, j, 1)=\text{"11111110"}.$$

namely, $$u_r(i, j, 1)=254.$$

As shown in FIG. 20, this is the case corresponding to Case 3. In Case 3, irrespectively of the carry data $CRY_r$, the upper bit data $y_r^H$, which is the upper (m−1) bits of the pseudo gray level data $y_r$, is given by:

$$y_r^H(i, j, 1)=\text{"11111"}.$$

The LSB $y_r^{LSB}$ (i j, 1) of the pseudo gray level data $y_r$ (i, j, 1) is defined as follows. FIG. 22 shows the carry data $CRY_r$ (i, j, 1) and the least significant bit $y_r^{LSB}$ (i, j, 1), when the input gray level data $u_r$ is given by $$u_r(i, j, 1)=\text{"11111110"}.$$

namely, $$u_r(i, j, 1)=254.$$

In FIG. 23, similarly to FIG. 22, the values "0" and "1" indicate that the carry data $CRY_r$ (i, j, 1) are at "0" and "1", respectively. Moreover, the fact that the values "0" and "1" are hatched in FIG. 23 implies that the least significant bit $y_r^{LSB}$ (i, j, 1) is at "1". Also, the fact that they are not hatched in FIG. 23 implies that the least significant bit $y_r^{LSB}$ (i, j, 1) is at "0".

The case when the carry data $CRY_r$ (i, j, 1) is "0" corresponds to Case 3-1. In Case 3, the LSB $y_r^{LSB}$ (i, j, 1) is $z_r$ (j, 1). Since k=1 in the first frame, $z_r$ (j, 1) is defined in accordance with the table of FIG. 21A.

With reference to FIG. 21A, when r="RA", "GA" and "BA" and j=1, 2, 3 and 4, the value $z_r$ (j, 1) is given by $$z_r(j, 1)=\text{"0"}.$$

Thus, when r="RA", "GA" and "BA", and j=1, 2, 3 and 4, and the carry data $CRY_r$ (i, j, 1) is "0", the LSB $y_r^{LSB}$ (i, j, 1) is at "0".

For example, in the case when i=1, the carry data $CRY_{RA}$, $CRY_{GA}$, $CRY_{BA}$, the LSB $y_{RA}^{LSB}$, $y_{GA}^{LSB}$, and $y_{BA}^{LSB}$ are given by:

$$CRY_{RA}(1, 1, 1)=\text{"0"}, y_{RA}^{LSB}(1, 1, 1)=\text{"0"},$$

$$CRY_{RA}(1, 2, 1)=\text{"0"}, y_{RA}^{LSB}(1, 2, 1)=\text{"0"},$$

$$CRY_{GA}(1, 3, 1)=\text{"0"}, y_{GA}^{LSB}(1, 3, 1)=\text{"0"},$$

$$CRY_{GA}(1, 4, 1)=\text{"0"}, y_{GA}^{LSB}(1, 4, 1)=\text{"0"},$$

$$CRY_{BA}(1, 1, 1)=\text{"0"}, y_{BA}^{LSB}(1, 1, 1)=\text{"0"},$$

$$CRY_{BA}(1, 4, 1)=\text{"0"}, y_{BA}^{LSB}(1, 4, 1)=\text{"0"}.$$

On the other hand, when r="RB", "GB" and "BB" and j=1, 2, 3 and 4, with reference to FIG. 21A, the value $z_r$ is given by:

$$z_r(j, 1)=\text{"1"}.$$

Thus, when r="RB", "GB" and "BB" and j=1, 2, 3 and 4, even in the case when the carry data $CRY_r$ (i, j, 1) is "0", the LSB $y_r^{LSB}$ (i, j, 1) is at "1".

For example, in the case of i=1, the carry data $CRY_{RB}$, $CRY_{GB}$, $CRY_{BB}$, the LSB $y_{RB}^{LSB}$, $y_{GB}^{LSB}$, and $y_{BB}^{LSB}$ are given by:

$$CRY_{RB}(1, 2, 1)=\text{"0"}, y_{RA}^{LSB}(1, 2, 1)=\text{"1"},$$

$$CRY_{RB}(1, 3, 1)=\text{"0"}, y_{RA}^{LSB}(1, 3, 1)=\text{"1"},$$

$$CRY_{GB}(1, 1, 1)=\text{"0"}, y_{GA}^{LSB}(1, 1, 1)=\text{"1"},$$

$$CRY_{GB}(1, 2, 1)=\text{"0"}, y_{GA}^{LSB}(1, 2, 1)=\text{"1"},$$

$$CRY_{BB}(1, 3, 1)=\text{"0"}, y_{BA}^{LSB}(1, 3, 1)=\text{"1"},$$

$$CRY_{BB}(1, 4, 1)=\text{"0"}, y_{BA}^{LSB}(1, 4, 1)=\text{"1"}.$$

On the other hand, the case when the carry data $CRY_r$ (i, j, 1) is "1" corresponds to Case 3-2. In Case 3-2, the LSB $y_r^{LSB}$ (i, j, 1) is at "1".

With regard to another r, j, k, and i, the LSB $y_r^{LSB}$ (i, j, k) are calculated in the same way.

As mentioned above, the pseudo gray level processor 13 in the third embodiment allows the m-bit pseudo gray level data $y_r$ (i, j, k) to indicate the $2^n$ gray levels.

The pseudo gray level processor 13 in the third embodiment is desirable over the pseudo gray level processors 3 in the first and second embodiments, since the fixed pattern is hard to be induced in the display of the LCD 1. As described in the first embodiment, in the pseudo gray level process in the first embodiment, the initial state variable data $x_r^{INI}$ is generated as shown in the table of FIG. 6 so that the fixed pattern is hard to be induced in the picture displayed on the LCD 1. However, if all the pixels 8 contained in the LCD 1 display the picture to be turned on in the gray level corresponding to Case 2 or 3 as explained in the operational examples 1 and 2, continuously over many frames, there may be a case of a generation of a stripe design of a fixed pattern. In this case, if the pseudo gray level process in the third embodiment is used, the fixed pattern is hard to be induced.

In the pseudo gray level processor 13 in the third embodiment, the LSB $y_r^{LSB}$ (i, j, k) generated for Case 2-2 or Case 3-1 is defined on the basis of the position of the pixels 8 and the frame to which the input gray level data $u_r$ (i, j, k) is inputted. In any one of the pixels 8, the least significant bit $y_r^{LSB}$ (i, j, k) is changed for each four frames. Thus, the fixed pattern is hard to be induced in the display of the LCD 1.

As described above, the m-bit pseudo gray level data $y_r$ (i, j, k) generated by the pseudo gray level processor 13 in the third embodiment can indicate the $2^n$ gray levels. Moreover, the least significant bit $y_r^{LSB}$ (i, j, k) of the pseudo gray level data $y_r$ (i, j, k) is defined as mentioned above. Thus, the fixed pattern is hard to be induced in the display of the LCD 1.

Figure 24:
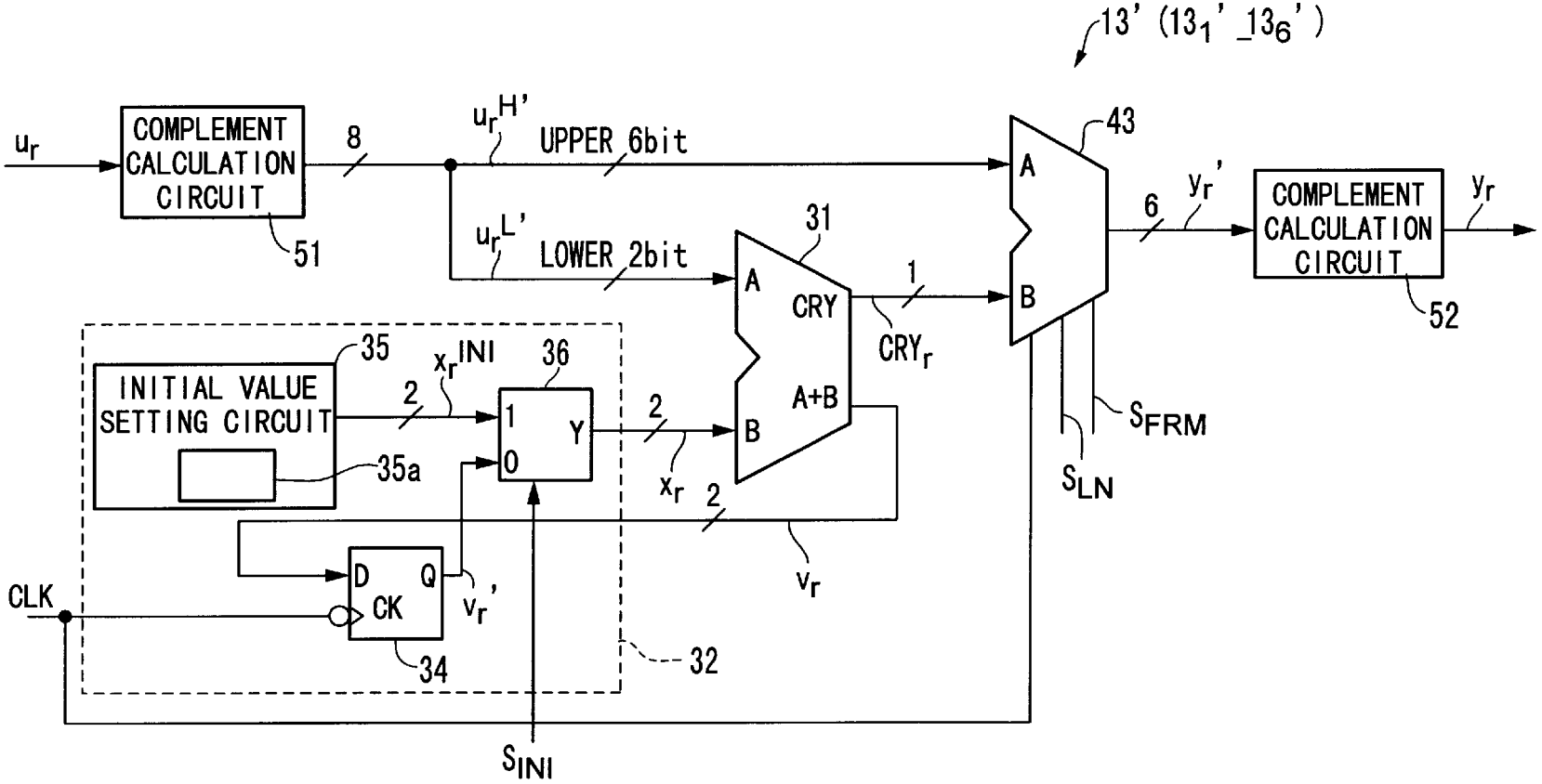
FIG. 24 shows a pseudo gray level processor 13'.

Also in the third embodiment, similarly to the first and second embodiments, the LCD 1 may be another display apparatus that is directly driven on the basis of the digitized input picture signal, for example, such as PDP Moreover, in the third embodiment, the pseudo gray level processor 13 may be replaced by the pseudo gray level processor 13' shown in FIG. 24. The pseudo gray level processor 13' has the configuration in which the complement calculation circuits 51, 52 are added to the pseudo gray level processor 13. In this case, the pseudo gray level processor 13' performs the calculation described in the third embodiment, on the complement of the input gray level data $u_r$, and calculates the complement pseudo gray level data $y_r'$. Moreover, the pseudo gray level processor 13' obtains the complement of the complement pseudo gray level data $y_r'$, and calculates the pseudo gray level data $y_r$.

This corresponds to the operation in which all the additions done in the third embodiment are replaced by the subtractions. FIG. 25 shows the correspondence relation between the input gray level data $u_r$ and the pseudo gray level data $y_r$ in this case. Also, in this case, the m-bit pseudo gray level data $y_r$ (i, j, k) generated by the pseudo gray level processor 13' can indicate the $2^n$ gray levels in the pseudo manner.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A display apparatus comprising:

a pseudo gray level data processor generating pseudo gray level data having m bits based on input gray level data having n bits representative of an input gray level of $2^n$ gray levels, n being a natural number equal to or more than 2, and m being a natural number less than n, wherein said pseudo gray level data processor includes:

a state variable generator generating state variable data having n−m bits, based on lower n−m bits of said input gray level data, an adder calculating a sum of said lower n−m bits of said input gray level data and said state variable data to output a carry bit representative of carry-over of said sum, and a pseudo gray level data calculator generating said pseudo gray level data based on said input gray level data and said carry bit, and wherein said pseudo gray level data calculator defines said pseudo gray level data such that said pseudo gray level data equals upper m bits of said input gray level data in a first case when said carry bit is "0" and said input gray level belongs to first gray levels of said $2^n$ gray levels, and such that upper m−1 bits of said pseudo gray level data equals upper m−1 bits of said input gray level data and the LSB (least significant bit) of said pseudo gray level data is selected from "0" and "1" in a second case when said carry bit is "1" and said input gray level data belongs to said first gray levels.

2. The display apparatus according to claim 1, wherein upper m−1 bits of said input gray level data are "1" and the m-th significant bit of said input gray level data is "0" when said input gray level data represents any one of said first gray levels.

3. The display apparatus according to claim 1, wherein a first probability of said LSB of said pseudo gray level data being "0" in said second case substantially equals a second probability of said LSB of said pseudo gray level data being "1" in said second case.

4. The display apparatus according to claim 1, further comprising a pixel matrix unit including pixels displaying a displaying gray level indicated by said pseudo gray level data, wherein said pseudo gray level data calculator determines said LSB of said pseudo gray level data in response to a position of said pixels in said pixel matrix unit.

5. The display apparatus according to claim 4, wherein said pixels includes first and second pixels, said first pixels displaying a first displaying gray level indicated by said pseudo gray level data having said LSB of "1" in said second case, said second pixels displaying a second displaying gray level indicated by said pseudo gray level data having said LSB of "0" in said second case, and said pixel matrix unit includes a first area in which said first pixels are located and a second area in which said second pixels are located, and said first and second area are alternately located in said pixel matrix unit.

6. The display apparatus according to claim 1, wherein said pseudo gray level data calculator defines said gray level data such that said pseudo gray level data equals upper m bits of said input gray level data in a third case when said carry bit is "1" and said input gray level belongs to second gray levels of said $2^n$ gray levels other than said first gray levels, and such that upper m−1 bits of said pseudo gray level data equals upper m−1 bits of said input gray level data and said LSB of said pseudo gray level data is selected from "0" and "1" in a fourth case when said carry bit is "0" and said input gray level data belongs to said second gray levels.

7. The display apparatus according to claim 6, wherein upper m bits of said input gray level data are "1" and at least one of lower n−m bits of said input gray level data is "0" when said input gray level data represents any one of said second gray levels.

8. The display apparatus according to claim 6, wherein a third probability of said LSB of said pseudo gray level data being "0" in said fourth case substantially equals a fourth probability of said LSB of said pseudo gray level data being "1" in said fourth case.

9. The display apparatus according to claim 6, wherein said pseudo gray level data calculator defines said pseudo gray level data such that said pseudo gray level data equals a sum of said carry bit and upper m bits of said input gray level data in a fifth case when said input gray level does not belong to any of said first and second gray levels.

10. The display apparatus according to claim 1, wherein $x(1)=x_{INI}$, and $x(i)=u_L(i-1)+x(i-1)$ when i is a natural number equal to or more than 2, where u(i) is one of said input gray level data which is i-th inputted to said pseudo gray level data processor, $u_L(i)$ are lower n−m bits of u(i), x(i) is one of said state variant data which is produced in response to u(i), and $x_{INI}$ is a predetermined value.

11. A display apparatus comprising:

a pseudo gray level data processor generating pseudo gray level data having m bits based on input gray level data having n bits representative of an input gray level of $2^n$ gray levels, n being a natural number equal to or more than 2, and m being a natural number less than n, wherein said pseudo gray level data processor includes:

a state variable generator generating a state variable data having n−m bits, based on lower n−m bits of said input gray level data, an adder calculating a sum of said lower n−m bits of said input gray level data and said state variable data to output a carry bit representative of carry-over of said sum, and a pseudo gray level data calculator generating said pseudo gray level data based on said input gray level data and said carry bit, wherein said pseudo gray level data calculator defines said pseudo gray level data such that said pseudo gray level data equals upper m bits of said input gray level data in a third case when said carry bit is "1" and said input gray level belongs to second gray levels of said $2^n$ gray levels, and such that upper m−1 bits of said pseudo gray level data equals upper m−1 bits of said input gray level data and the LSB of said pseudo gray level data is selected from "0" and "1" in a fourth case when said carry bit is "0" and said input gray level data belongs to said second gray levels.

12. The display apparatus according to claim 11, wherein upper m bits of said input gray level data are "1" and at least one of lower n−m bits of said input gray level data is "0" when said input gray level data represents any one of said second gray levels.

13. The display apparatus according to claim 11, wherein a third probability of said LSB of said pseudo gray level data being "0" in said fourth case substantially equals a second probability of said LSB of said pseudo gray level data being "1" in said fourth case.

14. The display apparatus according to claim 11, wherein $x(1)=x_{INI}$, and $x(i)=u_L(i-1)+x(i-1)$ when i is a natural number equal to or more than 2, where u(i) is one of said input gray level data which is i-th inputted to said pseudo gray level data processor, $u_L(i)$ are lower n−m bits of u(i), x(i) is one of said state variant data which is produced in response to u(i), and $x_{INI}$ is a predetermined value.

15. A display apparatus comprising:

a pseudo gray level data processor generating pseudo gray level data having m bits based on input gray level data having n bits representative of an input gray level of $2^n$ gray levels, n being a natural number equal to or more than 2, and m being a natural number less than n, wherein said pseudo gray level data processor includes:

a state variable generator generating state variable data having n−m bits, based on lower n−m bits of said input gray level data, a subtracter calculating a difference said lower n−m bits of said input gray level data minus and said state variable data to output a carry bit representative of carry-over of said difference, and a pseudo gray level data calculator generating said pseudo gray level data based on said input gray level data and said carry bit, and wherein said pseudo gray level data calculator defines said pseudo gray level data such that said pseudo gray level data equals upper m bits of said input gray level data in a first case when said carry bit is "0" and said input gray level belongs to first gray levels of said $2^n$ gray levels, and such that upper m−1 bits of said pseudo gray level data equals upper m−1 bits of said input gray level data and the LSB of said pseudo gray level data is selected from "0" and "1" in a second case when said carry bit is "1" and said input gray level data belongs to said first gray levels.

16. The display apparatus according to claim 15, wherein said pseudo gray level data calculator defines said gray level data such that said pseudo gray level data equals upper m bits of said input gray level data in a third case when said carry bit is "1" and said input gray level belongs to second gray levels of said $2^n$ gray levels other than said first gray levels, and such that upper m−1 bits of said pseudo gray level data equals upper m−1 bits of said input gray level data and said LSB of said pseudo gray level data is selected from "0" and "1" in a fourth case when said carry bit is "0" and said input gray level data belongs to said second gray levels.

17. The display apparatus according to claim 16, wherein said pseudo gray level data calculator defines said pseudo gray level data such that said pseudo gray level data equals a difference upper m bits of said input gray level data minus said carry bit in a fifth case when said input gray level does not belong to any of said first and second gray levels.

18. The display apparatus according to claim 15, wherein $x(1)=x_{INI}$, and $x(i)=u_L(i-1)-x(i-1)$ when i is a natural number equal to or more than 2, where u(i) is one of said input gray level data which is i-th inputted to said pseudo gray level data processor, $u_L(i)$ are lower n−m bits of u(i), x(i) is one of said state variant data which is produced in response to u(i), and $x_{INI}$ is a predetermined value.

19. A display apparatus comprising:

a pseudo gray level data processor generating pseudo gray level data having m bits based on input gray level data having n bits representative of an input gray level of $2^n$ gray levels, n being a natural number equal to or more than 2, and m being a natural number less than n, wherein said pseudo gray level data processor includes:

a state variable generator generating state variable data having n−m bits, based on lower n−m bits of said input gray level data, a subtracter calculating a difference said lower n−m bits of said input gray level data minus said state variable data to output a carry bit representative of carry-over of said difference, and a pseudo gray level data calculator generating said pseudo gray level data based on said input gray level data and said carry bit, wherein said pseudo gray level data calculator defines said pseudo gray level data such that said pseudo gray level data equals upper m bits of said input gray level data in a third case when said carry bit is "1" and said input gray level belongs to second gray levels of said $2^n$ gray levels, and such that upper m−1 bits of said pseudo gray level data equals upper m−1 bits of said input gray level data and the LSB of said pseudo gray level data is selected from "0" and "1" in a fourth case when said carry bit is "0" and said input gray level data belongs to said second gray levels.

20. The display apparatus according to claim 19, wherein $x(1)=x_{INI}$, and $x(i)=u_L(i-1)-x(i-1)$ when i is a natural number equal to or more than 2, where u(i) is one of said input gray level data which is i-th inputted to said pseudo gray level data processor, $u_L(i)$ are lower n−m bits of u(i), x(i) is one of said state variant data which is produced in response to u(i), and $x_{INI}$ is a predetermined value.

21. A method of generating pseudo gray level data representative of pseudo gray level, comprising:

sequentially inputting input gray level data, each of which has n bits and is representative of an input gray level of $2^n$ gray levels, n being a natural number equal to or more than 2, and sequentially generating pseudo gray level data having m bits based on said input gray level data, m being a natural number less than n, wherein said sequentially generating includes:

delaying work data having n−m bits by a duration substantially equal to a temporal interval at which said input gray level data is inputted to output state variable data, calculating a sum of lower n−m bits of said input gray level data and said state variable data, outputting said sum as said work data, outputting a carry bit of said sum, defining said pseudo gray level data such that said pseudo gray level data equals upper m bits of said input gray level data in a first case when said carry bit is "0" and said input gray level belongs to first gray levels of said $2^n$ gray levels, and defining said pseudo gray level data such that upper m−1 bits of said pseudo gray level data equals upper m−1 bits of said input gray level data and the LSB of said pseudo gray level data is selected from "0" and "1" in a second case when said carry bit is "1" and said input gray level data belongs to said first gray levels.

22. The method of generating pseudo gray level data representative of pseudo gray level, comprising:

sequentially inputting input gray level data, each of which has n bits and is representative of an input gray level of $2^n$ gray levels, n being a natural number equal to or more than 2, and sequentially generating pseudo gray level data having m bits based on said input gray level data, m being a natural number less than n, wherein said sequentially generating includes:

delaying work data having n−m bits by a duration substantially equal to a temporal interval at which said input gray level data is inputted to output state variable data, calculating a difference lower n−m bits of said input gray level data minus said state variable data, outputting said difference as said work data, outputting a carry bit of said difference, defining said pseudo gray level data such that said pseudo gray level data equals upper m bits of said input gray level data in a first case when said carry bit is "0" and said input gray level belongs to first gray levels of said $2^n$ gray levels, and defining said pseudo gray level data such that upper m−1 bits of said pseudo gray level data equals upper m−1 bits of said input gray level data and the LSB of said pseudo gray level data is selected from "0" and "1" in a second case when said carry bit is "1" and said input gray level data belongs to said first gray levels.

* * * * *